US006562154B1

(12) United States Patent
Rioja et al.

(10) Patent No.: US 6,562,154 B1
(45) Date of Patent: May 13, 2003

(54) ALUMINUM SHEET PRODUCTS HAVING IMPROVED FATIGUE CRACK GROWTH RESISTANCE AND METHODS OF MAKING SAME

(75) Inventors: Roberto J. Rioja, Murrysville, PA (US); Robert W. Westerlund, Bettendorf, IA (US); Anne E. Roberts, Davenport, IA (US); Dhruba J. Chakrabarti, Export, PA (US); Diana K. Denzer, Lower Burrell, PA (US); Anthony Morales, Bettendorf, IA (US); Paul E. Magnusen, Pittsburgh, PA (US); Gregory B. Venema, Bettendorf, IA (US)

(73) Assignee: Aloca Inc., Pittsburgh, PA (US)

( * ) Notice: Subject to any disclaimer, the term of this patent is extended or adjusted under 35 U.S.C. 154(b) by 0 days.

(21) Appl. No.: 09/591,904

(22) Filed: Jun. 12, 2000

(51) Int. Cl.[7] ..... C22C 21/00; C22C 21/12

(52) U.S. Cl. ..... 148/415; 148/416; 148/417; 148/437; 148/440

(58) Field of Search ..... 148/415, 416, 148/417, 418, 437, 438, 439, 440

(56) References Cited

U.S. PATENT DOCUMENTS

| | | | | |
|---|---|---|---|---|
| 3,717,512 A | * | 2/1973 | Sperry et al. | 148/32.5 |
| 4,336,075 A | * | 6/1982 | Qusit et al. | 148/2 |
| 4,795,502 A | | 1/1989 | Cho | |
| 4,806,174 A | | 2/1989 | Cho et al. | |
| 4,816,087 A | | 3/1989 | Cho | |
| 4,832,910 A | | 5/1989 | Rioja et al. | |
| 4,844,750 A | | 7/1989 | Cho et al. | |
| 4,848,647 A | | 7/1989 | Gentry et al. | |
| 4,869,870 A | | 9/1989 | Rioja et al. | |
| 4,915,747 A | | 4/1990 | Cho | |
| 4,921,548 A | | 5/1990 | Cho | |
| 4,927,470 A | | 5/1990 | Cho | |
| 4,946,517 A | | 8/1990 | Cho | |
| 4,961,792 A | | 10/1990 | Rioja et al. | |

(List continued on next page.)

FOREIGN PATENT DOCUMENTS

| | | |
|---|---|---|
| EP | 0 273 600 | 7/1988 |
| EP | 0 325 937 A1 | 8/1989 |
| EP | 0 473 122 A1 | 3/1992 |
| GB | 2 257 435 A | 1/1993 |

OTHER PUBLICATIONS

Hargarter, H. et al., "Fatigue Properties of AL 8090", *Aluminum Alloys, Their Physical and Mechanical Properties (ICAA4)*, vol. II, Papers presented at the 4th International Conference on Aluminum Alloys, The Georgia Institute of Technology, School of Materials Science and Engineering, Atlanta, GA, Jul. 1994, pp. 420–427.

Aluminum Association, Inc., "Registration Record of Aluminum Association Designations and Chemical Composition Limits for Wrought Aluminum and Wrought Aluminum Alloys", Revised Jan. 1989, pp. 1–15, Washington, D.C.

Rioja, "Fabrication methods to manufacture isotropic Al–Li alloys and products for space and aerospace applications", *Materials Science and Engineering A257,* 1998, pp. 100–107.

(List continued on next page.)

*Primary Examiner*—Roy King
*Assistant Examiner*—Janelle Combs Morillo
(74) *Attorney, Agent, or Firm*—Charles Q. Buckwalter; Alan G. Towner; Matthew W. Smith

(57) ABSTRACT

Aluminum sheet products having highly anisotropic grain microstructures and highly textured crystallographic microstructures are disclosed. The products exhibit improved strength and improved resistance to fatigue crack growth, as well as other advantageous properties such as improved combinations of strength and fracture toughness. The sheet products are useful for aerospace and other applications, particularly aircraft fuselages.

103 Claims, 26 Drawing Sheets

U.S. PATENT DOCUMENTS

| | | | | |
|---|---|---|---|---|
| 4,988,394 | A | 1/1991 | Cho | |
| 5,032,359 | A | 7/1991 | Pickens et al. | |
| 5,066,342 | A | 11/1991 | Rioja et al. | |
| 5,108,519 | A | 4/1992 | Armanie et al. | |
| 5,122,339 | A | 6/1992 | Pickens et al. | |
| 5,133,931 | A | 7/1992 | Cho | |
| 5,135,713 | A | 8/1992 | Rioja et al. | |
| 5,137,686 | A | 8/1992 | Rioja et al. | |
| 5,151,136 | A | 9/1992 | Witters et al. | |
| 5,211,910 | A | 5/1993 | Pickens et al. | |
| 5,213,639 | A | 5/1993 | Colvin et al. | |
| 5,259,897 | A | 11/1993 | Pickens et al. | |
| 5,376,192 | A | 12/1994 | Cassada, III | |
| 5,455,003 | A | 10/1995 | Pickens et al. | |
| 5,462,712 | A | 10/1995 | Langan et al. | |
| 5,512,241 | A | 4/1996 | Kramer et al. | |
| 5,624,632 | A | 4/1997 | Baumann et al. | |
| 5,759,302 | A | 6/1998 | Nakai et al. | 148/415 |
| 5,863,359 | A | 1/1999 | Karabin et al. | |
| 5,865,911 | A | 2/1999 | Miyasato et al. | |
| 5,865,914 | A | 2/1999 | Karabin et al. | |
| 5,938,867 | A | 8/1999 | Dorward et al. | |

OTHER PUBLICATIONS

Tempus, G. et al, "Influence of Extrusion Process Parameters on the Mechanical Properties of Al–Li Extrusions", Published in Al–Li IV, Paris, 1987.*

"ASM Handbook: vol. 9 Metallography and Microstructures", ASM International, 1985, pp 362–365.*

Lapasset, G., et al. "Influence de Facteurs Métallurgiques Sur La Ténacité Des Alliages D' Aluminium 7010 ET 7050", Recherche Aerospatiale, Organsation Europeene de Recherche Spatiales, Paris, France, No. 5, Sep. 1982, pp. 313–326.

Luevano A.J., et al. "Accumulation of Microstructural damage Due to Fatigue of High–Strength Aluminum Alloys", Journal of Materials Engineering and Performance, vol. 3(1) Feb. 1994, pp. 47–54.

Li, H.X., et al. "Mechanism of Anisotropy in Fracture Behaviour and Fracture Toughness of High Strength Aluminum Alloy Plate", Materials Science and Technology, vol. 6, Sep. 1990, pp. 850–856.

Kirman, I. "The Relation Between Microstructure and Toughness in 7075 Aluminum Alloy", Metallurgical Transactions, Metallurgical Society of AIME, vol. 2, Jul. 1971, pp. 1761–1770.

Patent Abstracts of Japan, vol. 1999, No. 10, Aug. 31, 1999 & JP 11 140578 A (Sky Alum Co Ltd), May 25, 1999, Abstract.

Barlat, F. et al. "On Crystallographic Texture and Anisotropy n Al–Li Sheet", The $4^{th}$ International Conference on Aluminum Alloys, pp. 389–396.

Reed, P. et al. "The Effect of Orientation on Short Crack Path and Growth Rate Behaviour in Al–Li Alloy AA8090", The $4^{th}$ International Conference on Aluminum Alloys, pp. 397–404.

* cited by examiner

2024-T3 sheet 0.125"

(b)

100 μm

2524-T3 sheet

ALUMINUM SHEET PRODUCTS HAVING IMPROVED FATIGUE CRACK GROWTH RESISTANCE AND METHODS OF MAKING SAME

FIELD OF THE INVENTION

The present invention relates to the production of rolled aluminum products having improved properties. More particularly, the invention relates to the manufacture of aluminum sheet products having controlled microstructures, which exhibit improved strength and fatigue crack growth resistance. The sheet products are useful for aerospace applications such as aircraft fuselages, as well as other applications.

BACKGROUND INFORMATION

Aircraft components such as fuselages are typically fabricated from aluminum sheet products. Resistance to the growth of fatigue cracks in such aerospace products is very important. Better fatigue crack growth resistance means that cracks will grow slower, thus making aircraft safer because small cracks can be more readily detected before they achieve a critical size which could lead to a catastrophic failure. In addition, slow crack growth can have an economic benefit because longer inspection intervals may be used. U.S. Pat. No. 5,213,639 to Colvin et al. discloses aluminum alloy products useful for aircraft applications.

The present invention provides rolled aluminum sheet products having improved resistance to fatigue crack growth, as well as other advantageous properties including improved combinations of strength and fracture toughness.

SUMMARY OF THE INVENTION

Aluminum sheet products fabricated in accordance with the present invention exhibit improved resistance to the propagation of cracks. Aluminum alloy compositions and processing parameters are controlled in order to increase fatigue crack growth resistance. This resistance is a result of a highly anisotropic grain microstructure which forces cracks to experience a transgranular or an intergranular tortuous propagation path. The number of cycles required to propagate these tortuous cracks to a critical crack length is significantly greater than the number of cycles required to propagate a crack that follows a smooth intergranular or non-tortuous path.

In an embodiment of the invention, alloy compositions, thermo-mechanical and thermal practices are controlled in order to develop an unrecrystallized microstructure or a desired amount of recrystallization. The microstructures are controlled with the help of dispersoids or precipitates which are formed at intermediate processing steps, or precipitation treatments to yield obstacles for dislocation and grain boundary motion. The sheet products comprise elongated grains, which form a highly anisotropic microstructure.

In accordance with one embodiment, the anisotropic microstructure may be developed as a result of hot rolling and additional thermal practices. The hot rolling temperature is controlled in order to facilitate the desired type, volume fraction and. distribution of crystallographic texture. In one embodiment, a recovery anneal after hot rolling yields the desired anisotropic microstructure after final solution heat treating and optional stretching and tempering operations. Additional intermediate anneals may be used to control the driving force for recrystallization.

The compositions of the aluminum products are preferably selected in order to provide dispersoid forming alloying elements, which control recrystallization and recovery processes during production. In one embodiment, mixtures of alloying elements that form the coherent $Cu_3Au$ prototype structure (L12 in the structurebereight nomenclature) are preferred. Such elements include Zr, Hf and Sc. In addition, alloying elements that form incoherent dispersoids such as Cr, V, Mn, Ni and Fe may also be utilized. Combinations of such alloying elements may be used.

An aspect of the present invention is to provide a rolled aluminum alloy sheet product having high levels of crystallographic anisotropy.

Another aspect of the present invention is to provide an Al—Cu base alloy sheet product having high levels of crystallographic anisotropy.

A further aspect of the present invention is to provide an aircraft fuselage sheet comprising a rolled aluminum alloy sheet product having an anisotropic microstructure.

Another aspect of the present invention is to provide a method of making an aluminum alloy sheet product having a highly anisotropic grain microstructure. The method includes the steps of providing an aluminum alloy, hot rolling the aluminum alloy to form a sheet, recovery/recrystallize annealing the hot rolled sheet, solution heat treating the annealed sheet, and recovering a sheet product having an anisotropic microstructure.

These and other aspects of the present invention will be more apparent from the following description.

DETAILED DESCRIPTION

In accordance with the present invention, a rolled aluminum alloy sheet product is provided which comprises a highly anisotropic microstructure. As used herein, the term "anisotropic microstructure" means a grain microstructure where the grains are elongated unrecrystallized grains or elongated recrystallized grains with an average aspect ratio of length to thickness of greater than about 4 to 1. The average grain aspect ratio is preferably greater than about 6 to 1, more preferably greater than about 8 to 1. In a particularly preferred embodiment, the anisotropic microstructure has an average grain aspect ratio of greater than about 10 to 1. In both instances of recrystallized or unrecrystallized grains, the common feature among recrystallized and unrecrystallized grain microstructures is that the grains are elongated. Observation of these grains may be done, for example, by optical microscopy at 50× to 10× in properly polished and etched samples observed through the thickness in the longitudinal orientation. For recrystallized products, the anisotropic microstructures achieved in accordance to the present invention preferably exhibit a Goss texture, as determined by standard methods, of greater than 20, more preferably greater than 30 or 40. For unrecrystallized products, the anisotropic microstructures preferably exhibit a Brass texture, as determined by standard methods, of greater than 20, more preferably greater than 30 or 40.

As used herein, the term "sheet" includes rolled aluminum products having thicknesses of from about 0.01 to about 0.35 inch. The thickness of the sheet is preferably from about 0.025 to about 0.325 inch, more preferably from about 0.05 to about 0.3 inch. For many applications such as some aircraft fuselages, the sheet is preferably from about 0.05 to about 0.25 inch thick, more preferably from about 0.05 to about 0.2 inch. The sheet may be unclad or clad, with preferred cladding layer thicknesses of from about 1 to about 5 percent of the thickness of the sheet.

As used herein, the term "unrecrystallized" means a sheet-product that exhibits grains that relate to the original grains present in the ingot or intermediate slab. The original grains have only been physically deformed. As a result, the unrecrystallized grain microstructures also exhibit a strong hot rolling crystallographic texture. The term "recrystallized" as used herein means grains that have formed from the original deformed grains. This occurs typically during hot rolling, during solution heat treating or during anneals, these anneals can be intermediate between hot rolling and/or prior to solution heat treating.

Figure 1:
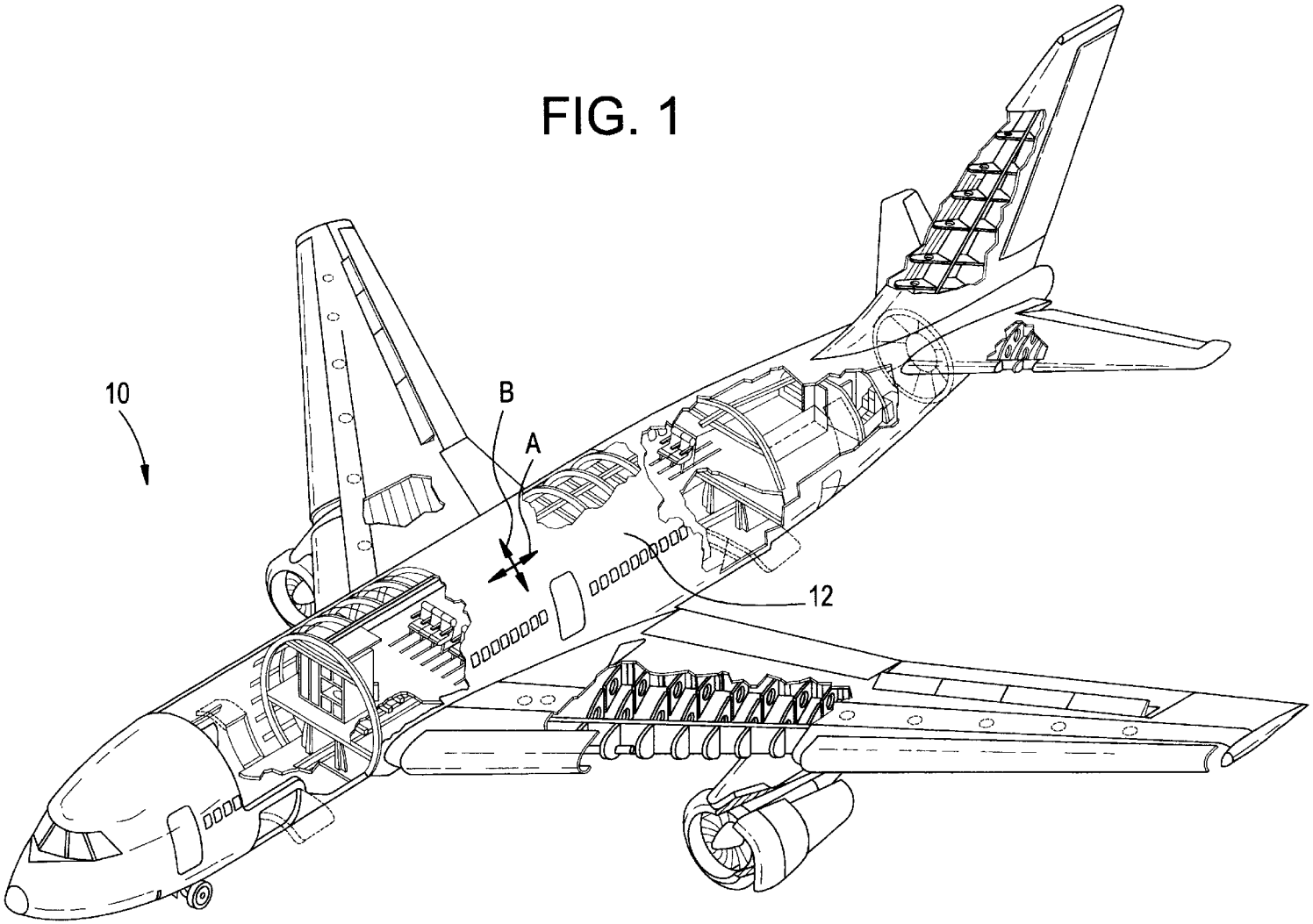
FIG. 1 is a partially schematic drawing of an airplane including an aluminum alloy fuselage sheet, indicating the orientation of typical fatigue cracks which tend to develop in the fuselage sheet.

In one embodiment of the invention, the sheet products are useful as aircraft fuselage sheet. FIG. 1 schematically illustrates an airplane 10 including a fuselage 12 which may be made of the present wrought aluminum alloy sheet. The aluminum alloy sheet may be provided with at least one aluminum cladding layer by methods known in the art. The clad or unclad sheet of the present invention may be assembled as an aircraft fuselage in a conventional manner known in the art. The arrows A and B in FIG. 1 indicate the orientations and propagation paths of fatigue cracks, which tend to develop in airplane fuselage sheet. In accordance with an embodiment, the anisotropic microstructure of the present sheet product is oriented on the fuselage such that the lengths of the high aspect ratio grains are substantially perpendicular to the likely fatigue crack propagation paths through the fuselage sheet. For example, either the longitudinal and/or long transverse orientations of the sheet may be positioned substantially perpendicular to the directions A or B shown in FIG. 1.

In accordance with the present invention, aluminum alloy compositions are controlled in order to increase fatigue crack growth resistance. Some suitable alloy compositions may include Aluminum Association 2xxx, 5xxx, 6xxx and 7xxx alloys, and variants thereof. For example, suitable aluminum alloy compositions for use in accordance with the present invention include Al—Cu base alloys, such as 2xxx alloys. A preferred Al—Cu base alloy comprises from about 1 to about 5 weight percent Cu, more preferably at least about 3 weight percent Cu, and from about 0.1 to about 6 weight percent Mg.

An example of a particularly preferred Al—Cu base alloy comprises from about 3.5 to about 4.5 weight percent Cu, from about 0.6 to about 1.6 weight percent Mg, from about 0.3 to about 0.7 weight percent Mn, and from about 0.08 to. about 0.13 weight percent Zr. In accordance with another preferred embodiment, the rolled aluminum alloy sheet product has a composition of from about 3.8 to about 4.4 weight percent Cu, from about 0.3 to about 0.7 weight percent Mn, from about 1.0 to about 1.6 weight percent Mg, and from about 0.09 to about 0.12 weight percent Zr. In accordance with a further preferred embodiment, the rolled aluminum sheet product has a composition of from about 3.4 to about 4.0 weight percent Cu, from 0 to about 0.4 weight percent Mn, from about 1.0 to about 1.6 weight percent Mg, and from about 0.09 to about 0.12 weight percent Zr. In accordance with another preferred embodiment, the rolled aluminum alloy sheet product has a composition of from about 3.2 to about 3.8 weight percent Cu, from about 0.3 to about 0.7 weight percent Mn, from about 1.0 to about 1.6 weight percent Mg, from about 0.09 to about 0.12 weight percent Zr and from about 0.25 to about 0.75 weight percent Li.

The Al—Cu base alloys produced in accordance with the present invention may comprise up to about 1 weight percent of at least one additional alloying element selected from Zn, Ag, Li and Si. These elements, when properly heat treated, may give rise to the formation of strengthening precipitates. Such precipitates form during natural aging at room temperature or during artificial aging, e.g., up to temperatures of 350° F.

The Al—Cu base alloys may further comprise up to about 1 weight percent of at least one additional alloying element selected from Hf, Sc, Zr and Li. These elements, when properly heat treated, may give rise to the formation or enhancement of coherent dispersoids. Such dispersoids may enhance the ability of the microstructure to be produced with elongated recrystallized or unrecrystallized grains.

The Al—Cu base alloys may further comprise up to about 1 weight percent of at least one additional alloying element selected from Cr, V, Mn, Ni and Fe. These elements, when properly heat treated, may give rise to the formation of incoherent dispersoids. Such dispersoids may help to control recrystallization and grain growth.

In addition to Al—Cu base alloys, Al—Mg base alloys, Al—Si base alloys, Al—Mg—Si base alloys and Al—Zn base alloys may be produced as sheet products having anisotropic microstructures. in accordance with the present invention. For example, Aluminum Association 5xxx, 6xxx and 7xxx alloys, or modifications thereof, may be fabricated into sheet products having anisotropic microstructures.

Suitable Al—Mg base alloys have compositions of from about 0.2 to about 7.0 weight percent Mg, from 0 to about 1 weight percent Mn, from 0 to about 1.5 weight percent Cu, from 0 to about 3 weight percent Zn, and from 0 to about 0.5 weight percent Si. In addition, Al—Mg base alloys may optionally include further alloying additions of up to about 1 weight percent strengthening additions selected from Li, Ag, Cd and lanthanides, and/or up to about 1 weight percent dispersoid formers such as Cr, Fe, Ni, Sc, Hf, Ti, V and Zr.

Suitable Al—Mg—Si base alloys have compositions of from about 0.1 to about 2.5 weight percent Mg, from about 0.1 to about 2.5 weight percent Si, from 0 to about 2 weight percent Cu, from 0 to about 3 weight percent Zn, and from 0 to about 1 weight percent Li. In addition, Al—Mg—Si base alloys may optionally include further alloying additions of up to about 1 weight percent strengthening additions selected from Ag, Cd and lanthanides, and/or up to about 1 weight percent dispersoid formers such as Mn, Cr, Ni, Fe, Sc, Hf; Ti, V and Zr.

Suitable Al—Zn base alloys have compositions of from about 1 to about 10 weight percent Zn, from about 0.1 to about 3 weight percent Cu, from about 0.1 to about 3 weight percent Mg, from 0 to about 2 weight percent Li, and from 0 to about 2 weight percent Ag. In addition, Al—Zn base alloys may optionally include further alloying additions of up to about 1 weight percent strengthening additions selected from Cd and lanthanides, and/or up to about 1 weight percent dispersoid formers such as Mn, Cr, Ni, Fe, Sc, Hf, Ti, V and Zr.

Figure 2:
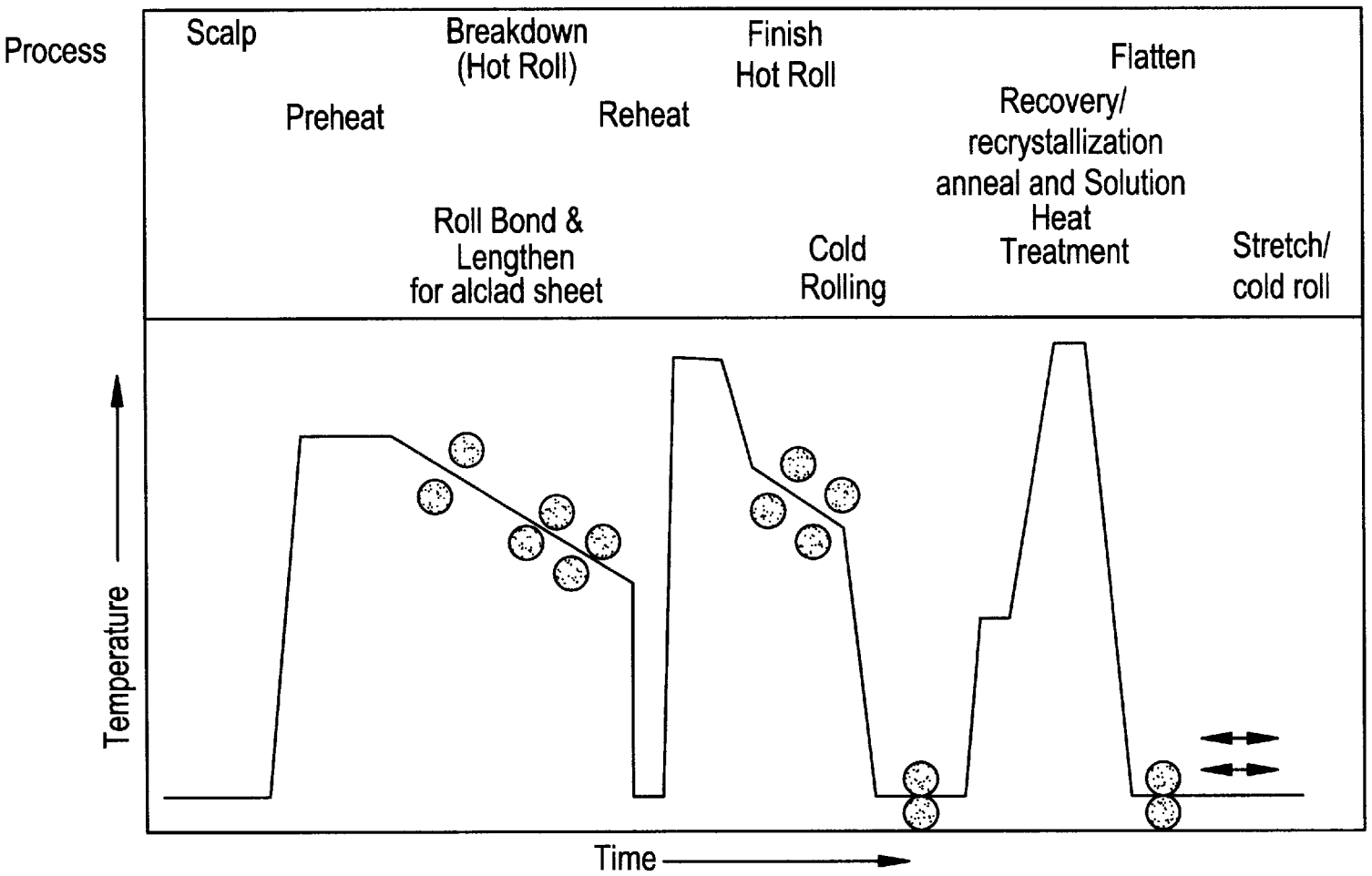
FIG. 2 is a fabrication map for an aluminum sheet product having an anisotropic microstructure produced in accordance with an embodiment of the present invention.

In accordance with the present invention, processing parameters are controlled in order to increase fatigue crack growth resistance of the rolled aluminum alloy sheet products. A preferred process includes the steps of casting, scalping, preheating, initial hot rolling, reheating, finish hot rolling, optional cold rolling, optional intermediate anneals during hot rolling and/or cold rolling, annealing for the control of anisotropic grain microstructures, solution heat treating, flattening and stretching and/or cold rolling. An example of a fabrication map is shown in FIG. 2. Another example of a fabrication may is shown in FIG. 3.

As illustrated in FIG. 2, a recovery anneal step is preferably utilized in the production of sheet products in accordance with the present invention. As illustrated in FIG. 3, intermediate anneals during hot rolling and/or cold rolling may be used in addition to, or in place of, the recovery anneal. It should be noted that the anneals can be provided by controlled heating or by single or multiple holding times at one or several temperatures.

Depending on the particular alloy composition, the preheating step is preferably carried out at a temperature of between 800 and 1,050° F. for 2 to 50 hours. The initial hot rolling is preferably performed at a temperature of from 750 to 1,020° F. with a reduction in thickness of from 0.1 to 3 inch percent per pass. Reheating is preferably carried out at a temperature of from 700 to 1,050° F. for 2 to 40 hours. The finish hot rolling step is preferably performed at a temperature of from 680 to 1,050° F. with a reduction in thickness of from 0.1 to 3 inch per pass.

Figure 3:
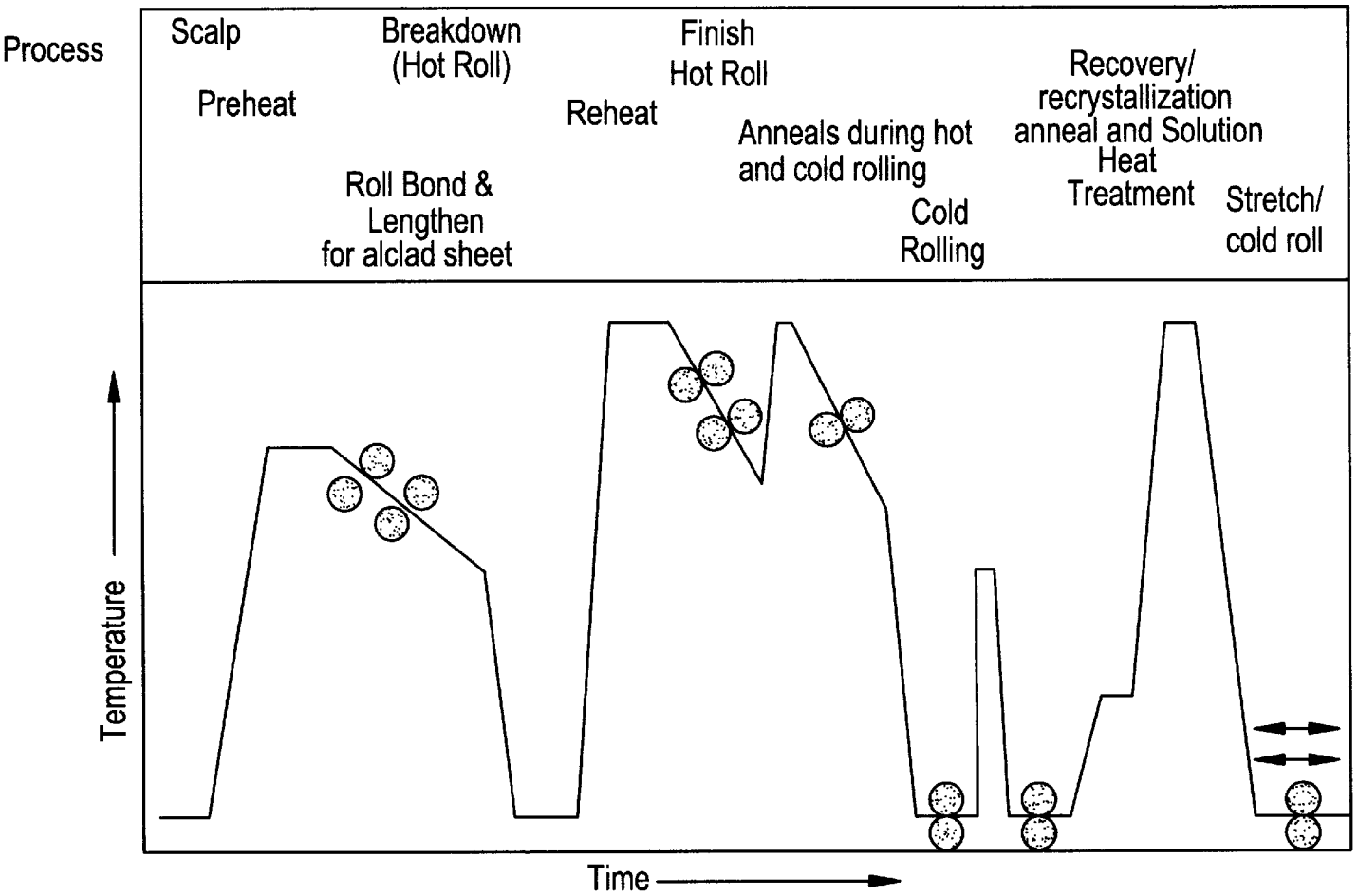
FIG. 3 is a fabrication map for an aluminum sheet product having an anisotropic microstructure produced in accordance with another embodiment of the present invention.

The optional intermediate anneals during hot rolling or cold rolling, e.g., as illustrated in FIG. 3, are preferably carried out at a temperature of between about 400 and about 1,000° F. for 0.5 to 24 hours.

The cold rolling step is preferably carried out at room temperature with a reduction in thickness of from 5 percent to 50 percent per pass.

The recovery/elongated grain recrystallization anneals, e.g., as illustrated in FIG. 2, are preferably carried out at a temperature of between about 300 and about 1,000° F. for 0.5 to 96 hours. Unrecrystallized anisotropic microstructures typically require anneals at relatively low temperatures, for example, from about 400 to about 700° F. Recrystallized anisotropic microstructures typically require anneals at relatively high temperatures, for example, from about 600 to about 1,000° F.

Solution heat treatment is preferably carried out at a temperature of from about 850 to about 1,060° F. for a time of from about 1 to 2 minutes to about 1 hour.

The quenching step is preferably carried out by rapid cooling using immersion into a suitable cooling fluid or by spraying a suitable cooling fluid.

The flattening and stretching steps are preferably carried out to provide no more than 6 percent of total cold deformation.

After solution heat treatment, cold working may optionally be performed, preferably by stretching or cold rolling. The cold working process preferably imparts a maximum of 15 percent cold deformation to the sheet product, more preferably a maximum of about 8 percent.

The sheet products, fabricated in accordance with the present invention exhibit substantially increased strength and/or resistance to the growth of fatigue cracks as a result of their anisotropic microstructures. In a preferred embodiment, the rolled sheet products exhibit longitudinal (L) tensile yield strengths (TYS) greater than 45 ksi, more preferably greater than 48 ksi. The rolled sheet products preferably exhibit long transverse (LT) tensile yield strengths greater than 40 ksi, more preferably greater than 43 ksi. In the long transverse (T-L) orientation, the rolled sheet in the T3 temper preferably exhibits a fatigue crack growth rate da/dN of less than about $5\times10^{-6}$ inch/cycle at a $\Delta K$ of 10 ksi√inch, more preferably less than about $4\times10^{-6}$ or $3\times10^{-6}$ inch/cycle. In the T36 temper, the rolled sheet exhibits a T-L orientation fatigue crack growth rate da/dN of less than about $4\times10^{-6}$ inch/cycle at a $\Delta K$ of 10 ksi√inch, more preferably less than $3\times10^{-6}$ or $2\times10^{-6}$ inch/cycle.

Furthermore, the present wrought aluminum alloy sheet products exhibit improved fracture toughness values, e.g., as tested with 16 by 44 inch center notch fracture toughness specimens in accordance with ASTM E561 and B646 standards. For example, sheet products produced in accordance with the present invention preferably exhibit longitudinal (L-T) or long transverse (T-L) $K_c$ fracture toughness values of greater than 130 or 140 ksi√inch. The sheet products also preferably possess L-T or T-L $K_{app}$ fracture toughness values of greater than 85 or 90 ksi√inch.

Thus, in addition to improved fatigue crack growth resistance, the present sheet products exhibit improved combinations of strength and fracture toughness.

Figure 4A:
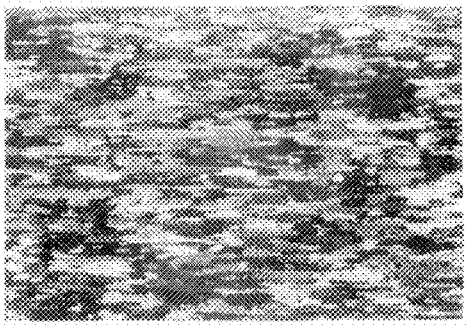
FIGS. 4*a* and 4*b* are photomicrographs illustrating the substantially "equiaxed" grains of Aluminum Association alloy 2024 and 2524 sheet products which are conventionally used as fuselage sheet.
Figure 4B:
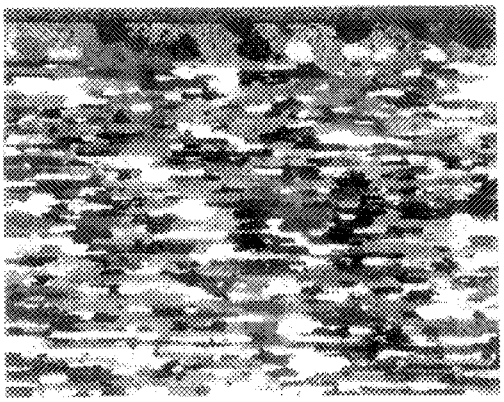
Figure 5A:
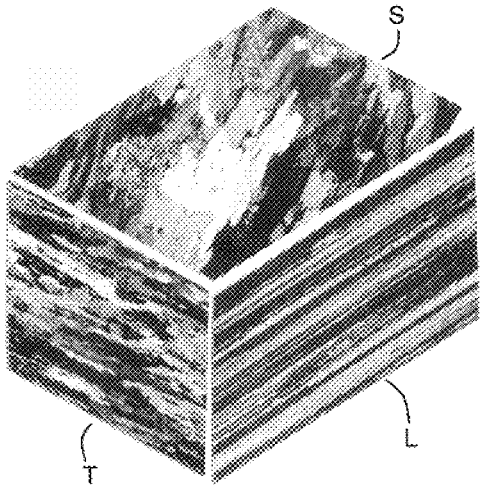
FIGS. 5*a* and 5*b* are photomicrographs illustrating the anisotropic microstructure of an aluminum sheet product produced in accordance with an embodiment of the present invention.
Figure 5B:
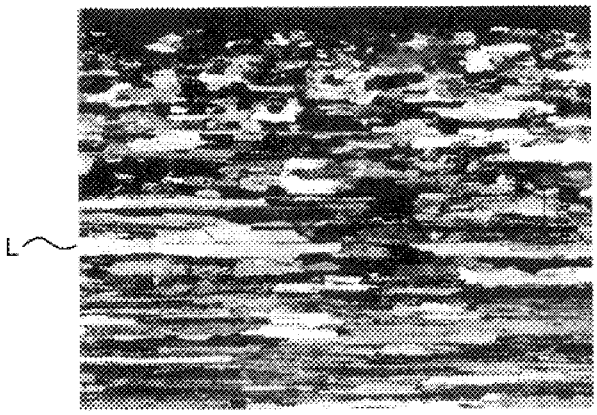
Figure 6A:
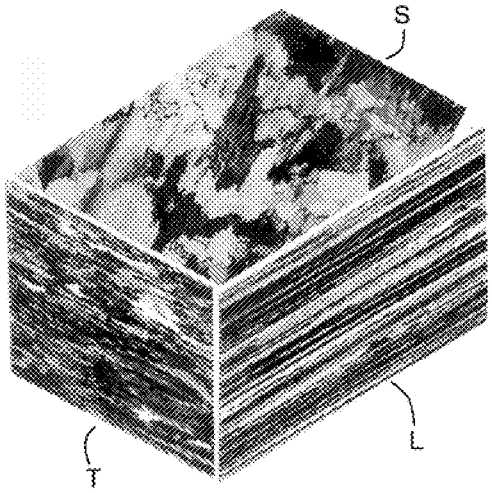
FIGS. 6*a* and 6*b* are photomicrographs illustrating the anisotropic microstructure of another aluminum sheet product produced in accordance with an embodiment of the present invention.
Figure 6B:
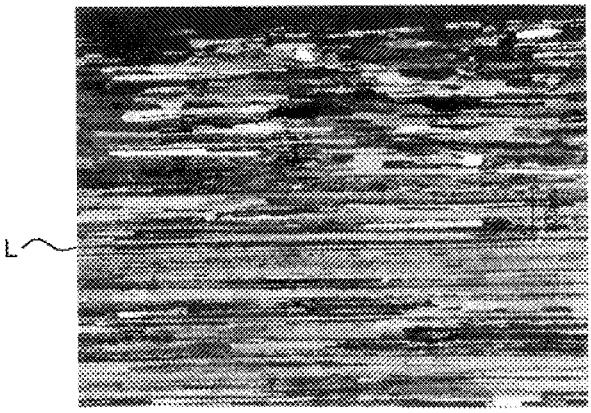
Figure 7A:
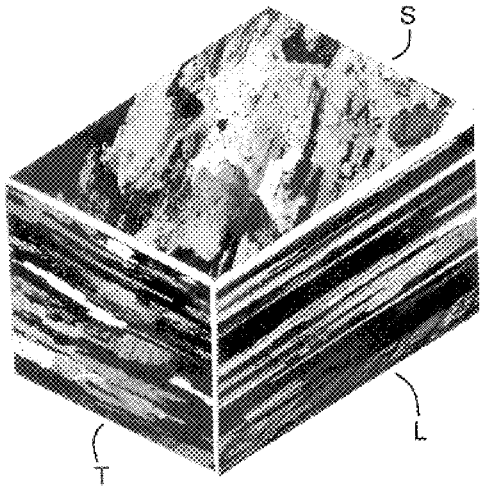
FIGS. 7*a* and 7*b* are photomicrographs illustrating the anisotropic microstructure of a further aluminum sheet product produced in accordance with an embodiment of the present invention.
Figure 7B:
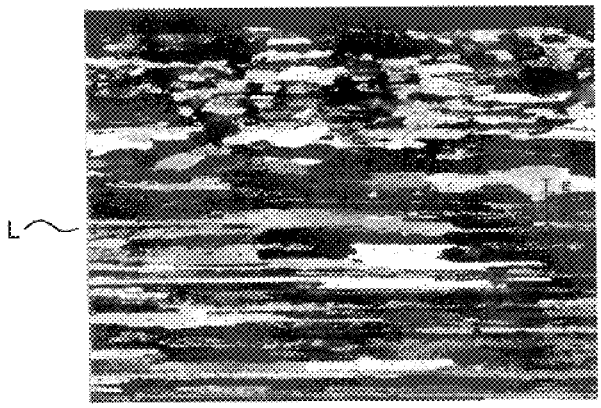
Figure 8A:
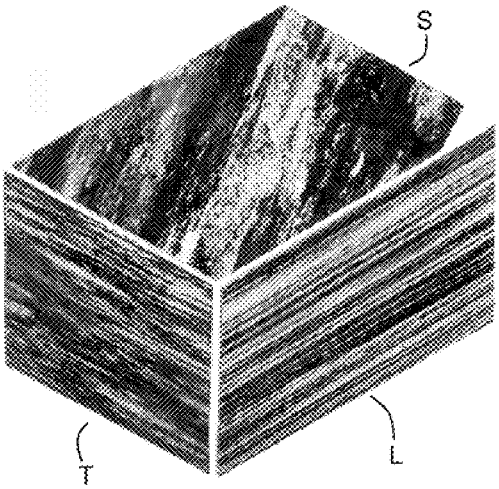
FIGS. 8*a* and 8*b* are photomicrographs illustrating the anisotropic microstructure of another aluminum sheet product produced in accordance with an embodiment of the present invention.
Figure 8B:
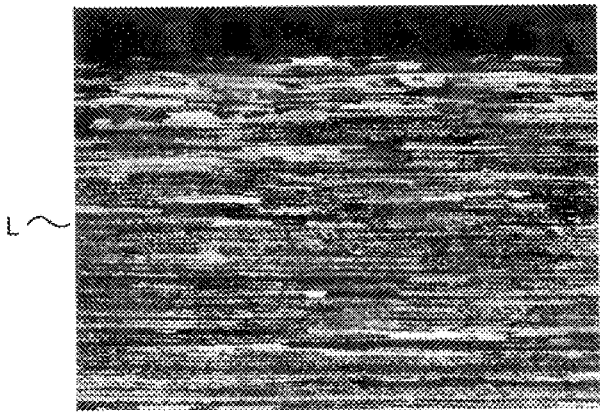
Figure 9A:
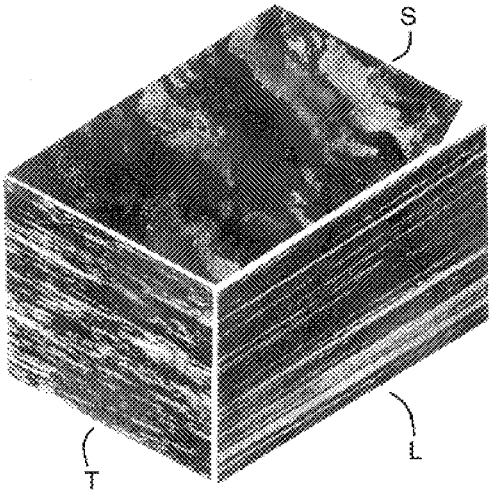
FIGS. 9*a* and 9*b* are photomicrographs illustrating the anisotropic microstructure of a further aluminum sheet product produced in accordance with an embodiment of the present invention.
Figure 9B:
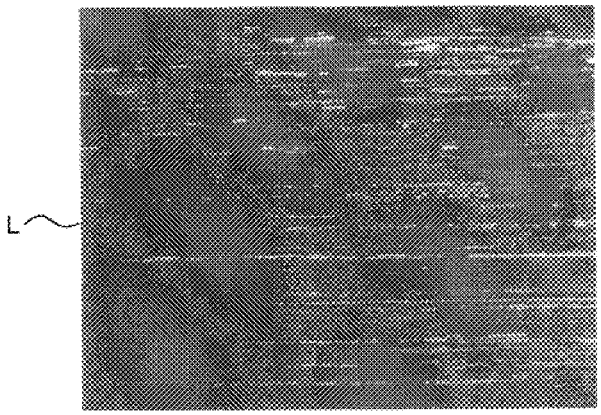
Figure 10A:
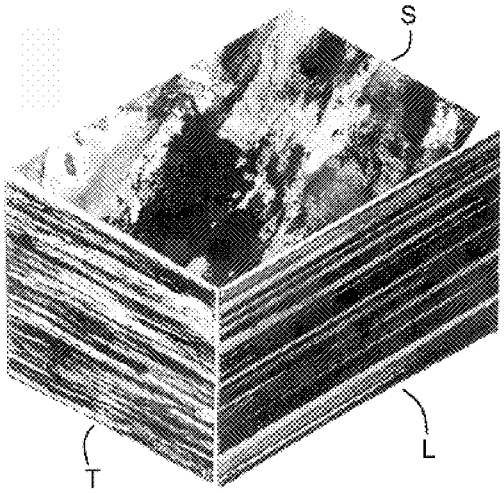
FIGS. 10*a* and 10*b* are photomicrographs illustrating the anisotropic microstructure of another aluminum sheet product produced in accordance with an embodiment of the present invention.
Figure 10B:
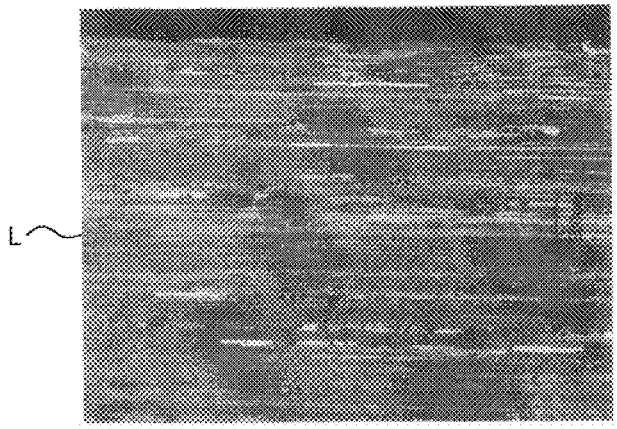

FIGS. 4*a* and 4*b* are photomicrographs illustrating the substantially equiaxed grains of conventional alloy 2024 and 2524 sheet products which are used as fuselage sheet. Unlike conventional fuselage sheet such as shown in FIGS. 4*a* and 4*b*, the anisotropic microstructure of the present sheet products enables aircraft manufacturers to orient the sheet in directions which take advantage of the increased mechanical properties of the sheet, such as improved longitudinal and/or long transverse fatigue crack growth resistance, fracture toughness and/or strength.

Table 1 below lists compositions of some sheet products, which may be processed to provide anisotropic microstructures in accordance with embodiments of the present invention.

TABLE 1

Sheet Product Alloy Compositions (Weight Percent)

| Alloy Sample No. | Cu | Mn | Mg | Zr | Sc | Li | Fe | Si | Al |
|---|---|---|---|---|---|---|---|---|---|
| 770-308 (Zr alloy) | 3.74 | 0 | 1.36 | 0.12 | 0 | 0 | 0.03 | 0.04 | balance |
| 770-311 (Zr + Li alloy) | 3.19 | 0 | 1.22 | 0.10 | 0 | 0.31 | 0.03 | 0.04 | balance |
| 770-309 (Mn + Zr alloy) | 4.26 | 0.57 | 1.4 | 0.10 | 0 | 0 | 0.07 | 0.04 | balance |
| 770-310 (Zr + Sc alloy) | 3.7 | 0 | 1.36 | 0.10 | 0.06 | 0 | 0.04 | 0.03 | balance |
| 770-312 (Zr + Sc + Li alloy) | 3.56 | 0 | 1.36 | 0.10 | 0.06 | 0.31 | 0.04 | 0.03 | balance |
| 596-367 (Mn + Zr + Li alloy) | 3.37 | 0.58 | 1.21 | 0.12 | 0 | 0.76 | 0.04 | 0.02 | balance |

The sheet products having compositions listed in Table 1 were made as follows. Ingots measuring 6 inches×16 inches×60 inches were cast using direct chill (DC) molds. The compositions reported in Table 1 were measured from metal samples obtained from the molten metal bath. Ingots were first stress relieved by heating to 750° F. for 6 hours. The ingots were then scalped to remove 0.25 inch surface layer from both rolling surfaces and side sawed to 14 inch width. For preheating, ingots were heated to 850° F., soaked for 2 hours, then heated to 875° F. and soaked an additional 2 hours. Ingots taken from the preheating furnace were cross rolled 22 percent to a 4.5 inch gauge followed by lengthening to a 2 inch gauge. Metal temperature was maintained above 750° F. with reheats to 850° F. for 15 minutes. The 2 inch slab was sheared in half and reheated to 915° F. for 8 hours, table cooled to 900° F. and hot rolled to 0.25 inch gauge. Suitable reheats were provided during hot rolling to 915° F. for 15 minutes. Metal temperature was kept above 750° F. After hot rolling, sheet product 0.150 inch gauge was fabricated. Recovery anneals prior to solution heat treatment of from 8 to 24 hours at temperatures from 400° F. to 550° F. yielded unrecrystallized microstructures after solution heat treatment.

After rolling, solution heat treating and quenching, all pieces of sheet were ultrasonically inspected to Class B and they all passed. Microstructural analyses revealed that all samples exhibited unrecrystallized microstructures in the final temper. FIGS. 5*a* to 10*b* are photomicrographs illustrating the anisotropic microstructures of the sheet products listed in Table 1. In each case, the sheet possesses high levels of crystallographic anisotropy and exhibits elongated grains. The grain anisotropy is most pronounced in the longitudinal direction (L) of each sheet, but is also present in the long transverse direction of each sheet.

Figure 11:
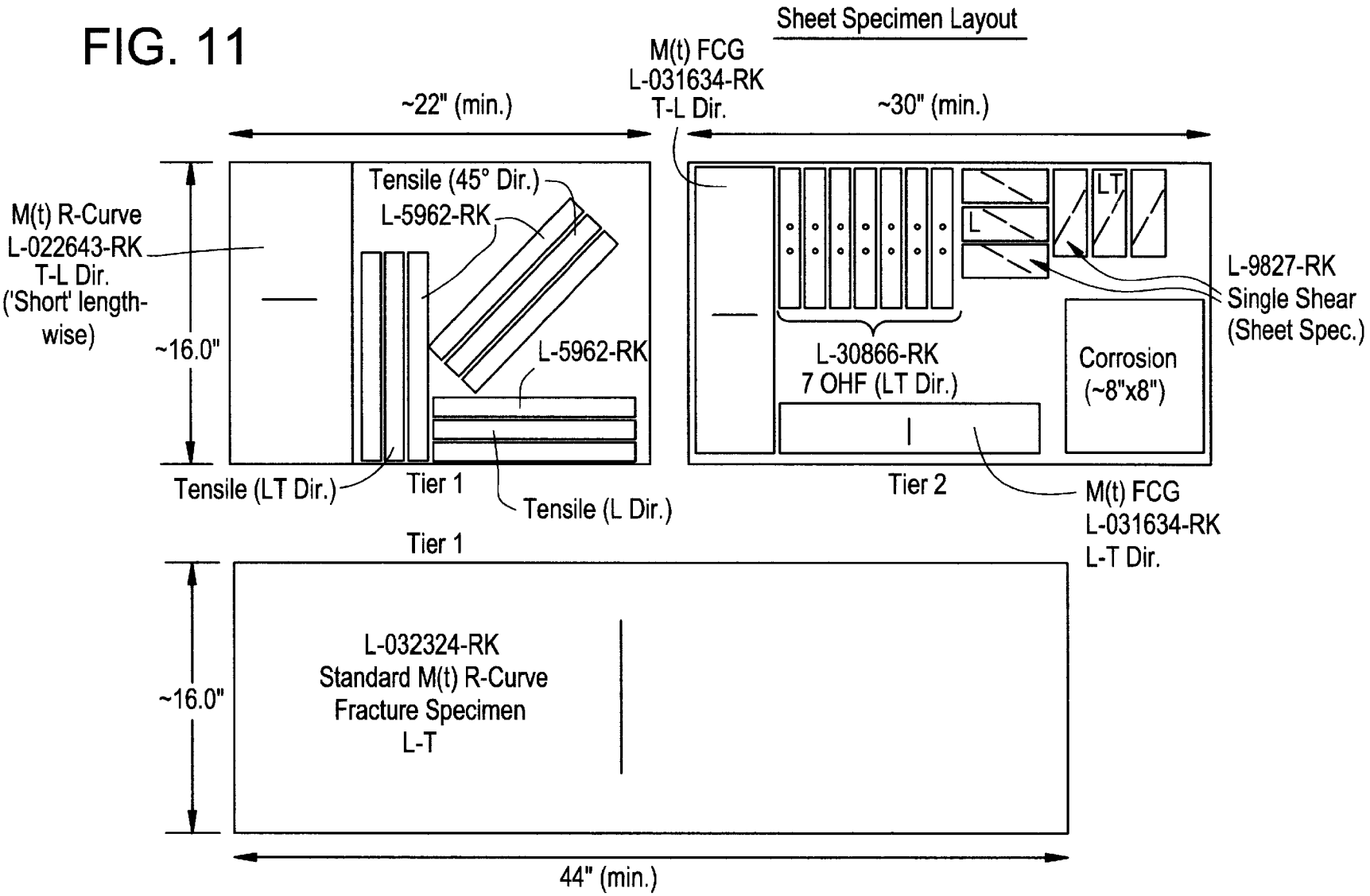
FIG. 11 illustrates the layout of specimens taken from sheet samples for testing.

Fabricated samples in accordance with the present invention were tested for mechanical properties. The diagram in FIG. 11 shows the locations and orientations of samples taken for the different tests.

Figure 12:
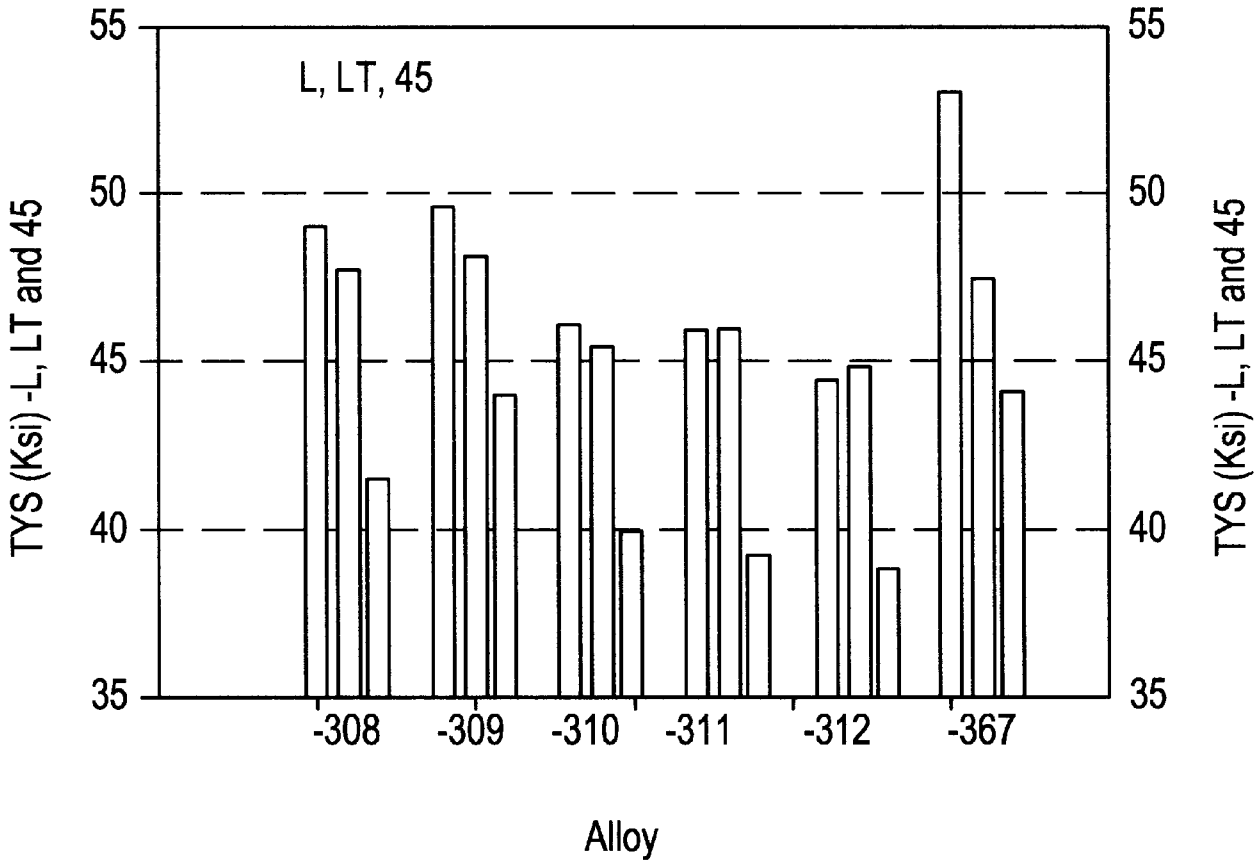
FIG. 12 is a graph illustrating tensile Yield strength values for sheet samples of the present invention in different orientations.

Results from tensile testing in the L, LT and 45 directions are shown in FIG. 12. Alloy 367 listed in Table 1 showed the highest strength in all three directions. However, the other alloys listed in Table 1 also exhibited favorable strength levels.

Figure 13:
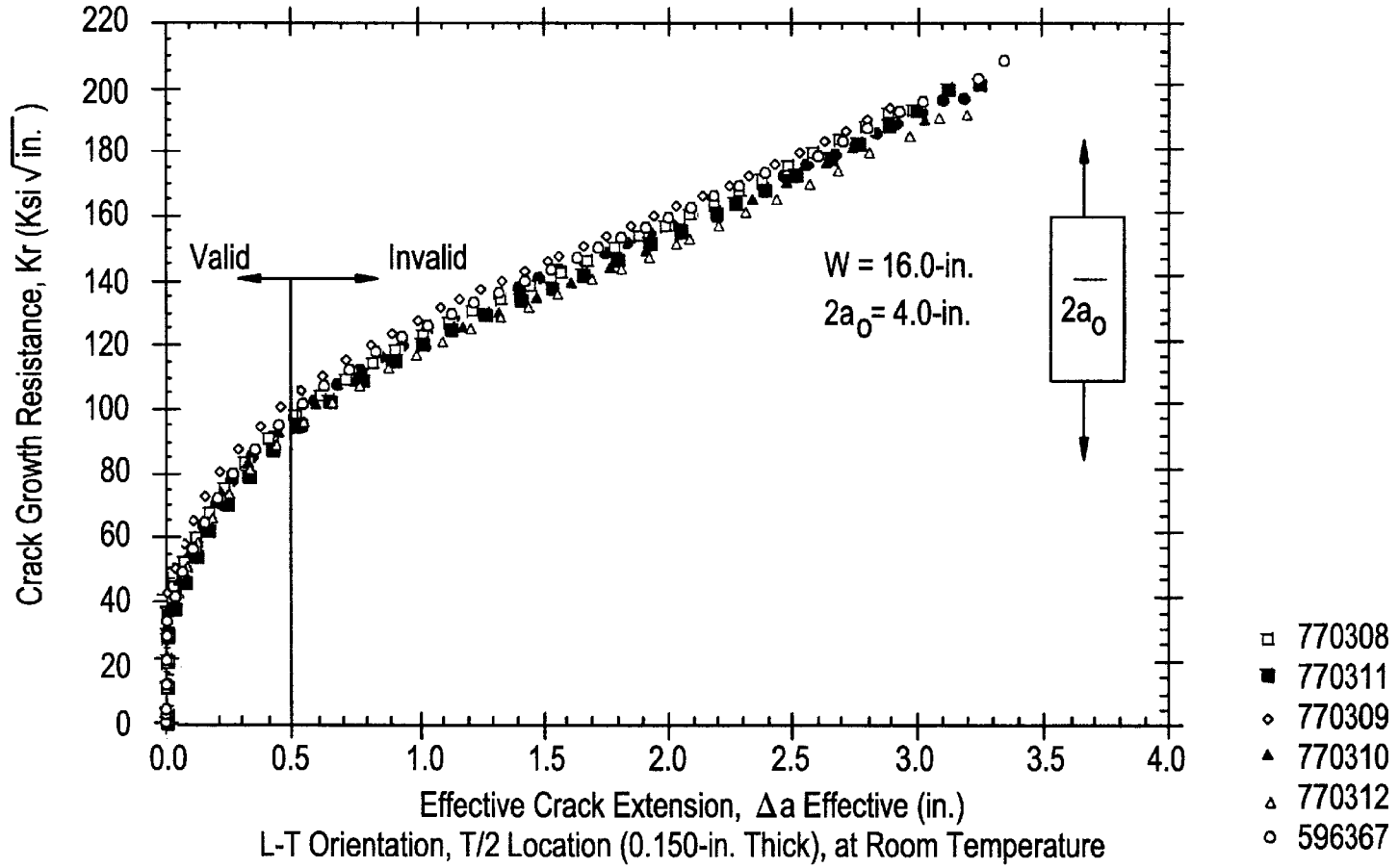
FIGS. 13 and 14 are graphs illustrating crack growth resistance curves for sheet. samples of the present invention.
Figure 14:
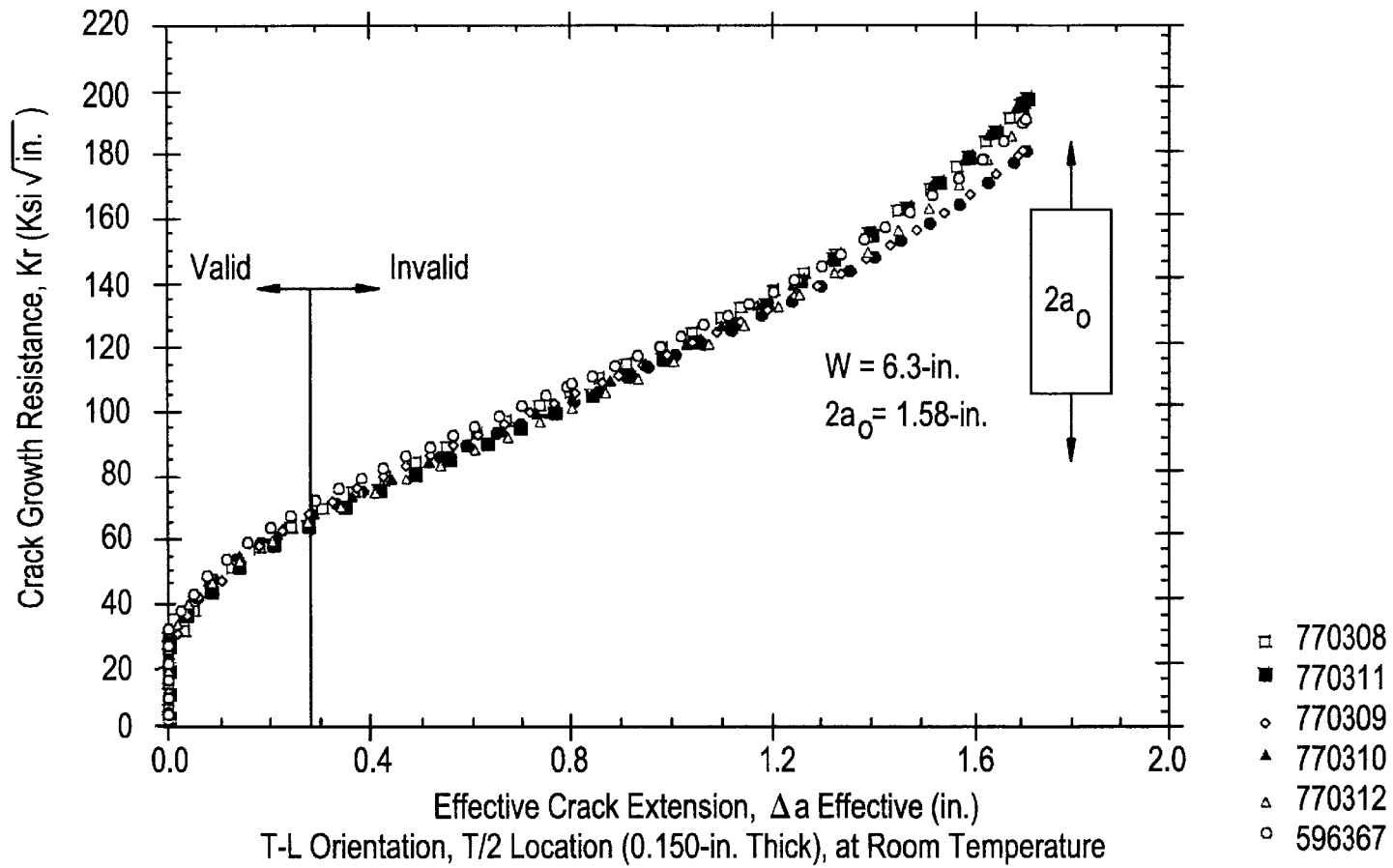

Fracture toughness tests were conducted from 16 by 44 inch center notch specimens with 4 inch initial center cracks. FIGS. 13 and 14 illustrate R-curves from fracture toughness testing, showing that the test specimens of the present sheet products possess favorable fracture toughness values comparable to alclad 2524 T3 sheet. The R curves are comparable for all of the alloys tested.

Figure 15:
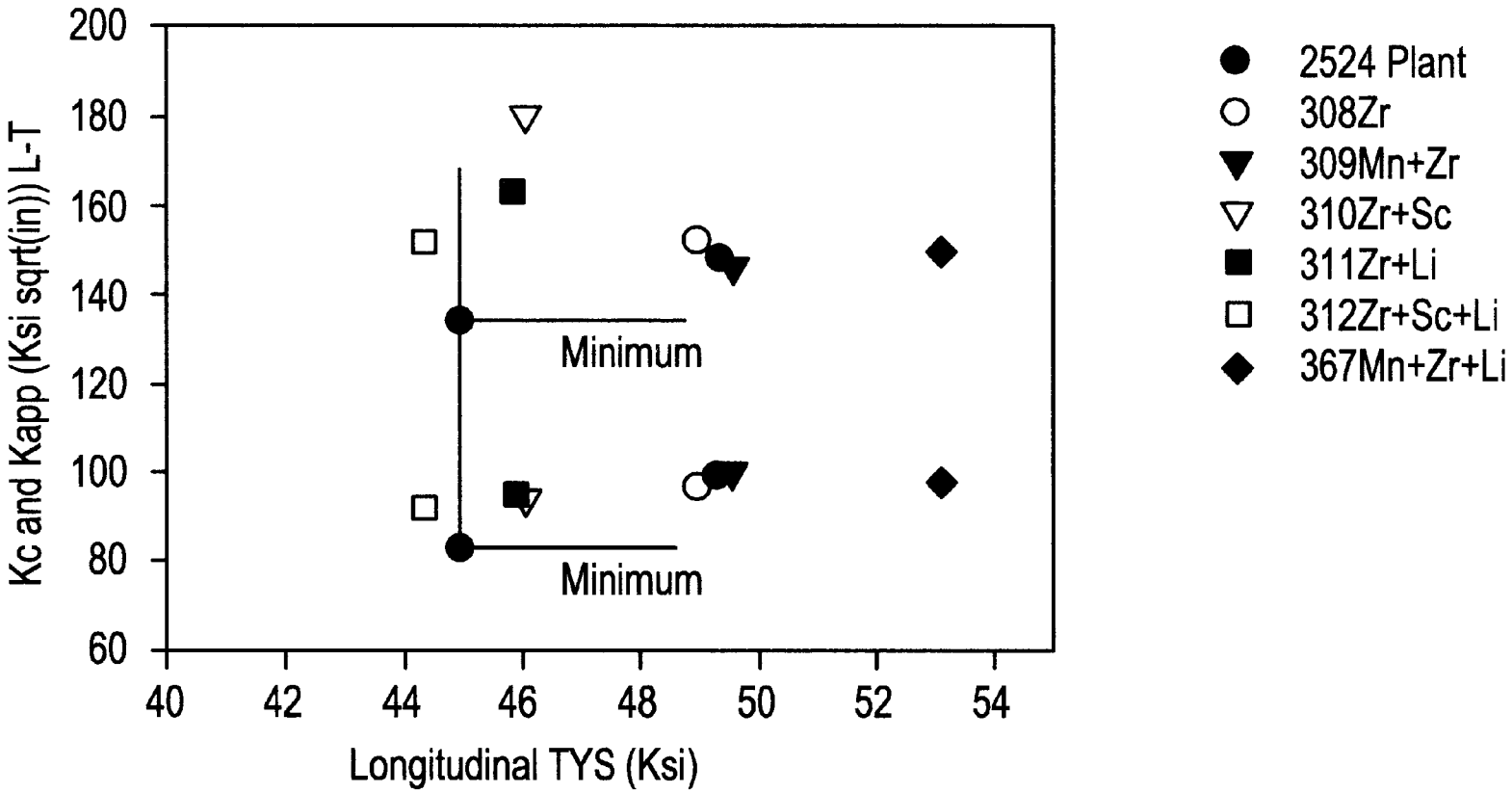
FIG. 15 is a graph illustrating fracture toughness and tensile yield strength for sheet samples of the present invention.

The improved strength/toughness combinations attained are shown in FIG. 15. FIG. 15 also shows an average value from 2524-T3 plant fabricated aldad sheet for comparison purposes. The minimum values shown in FIG. 15 correspond to a minus 3 times the standard deviation extrapolated value.

Figure 16:
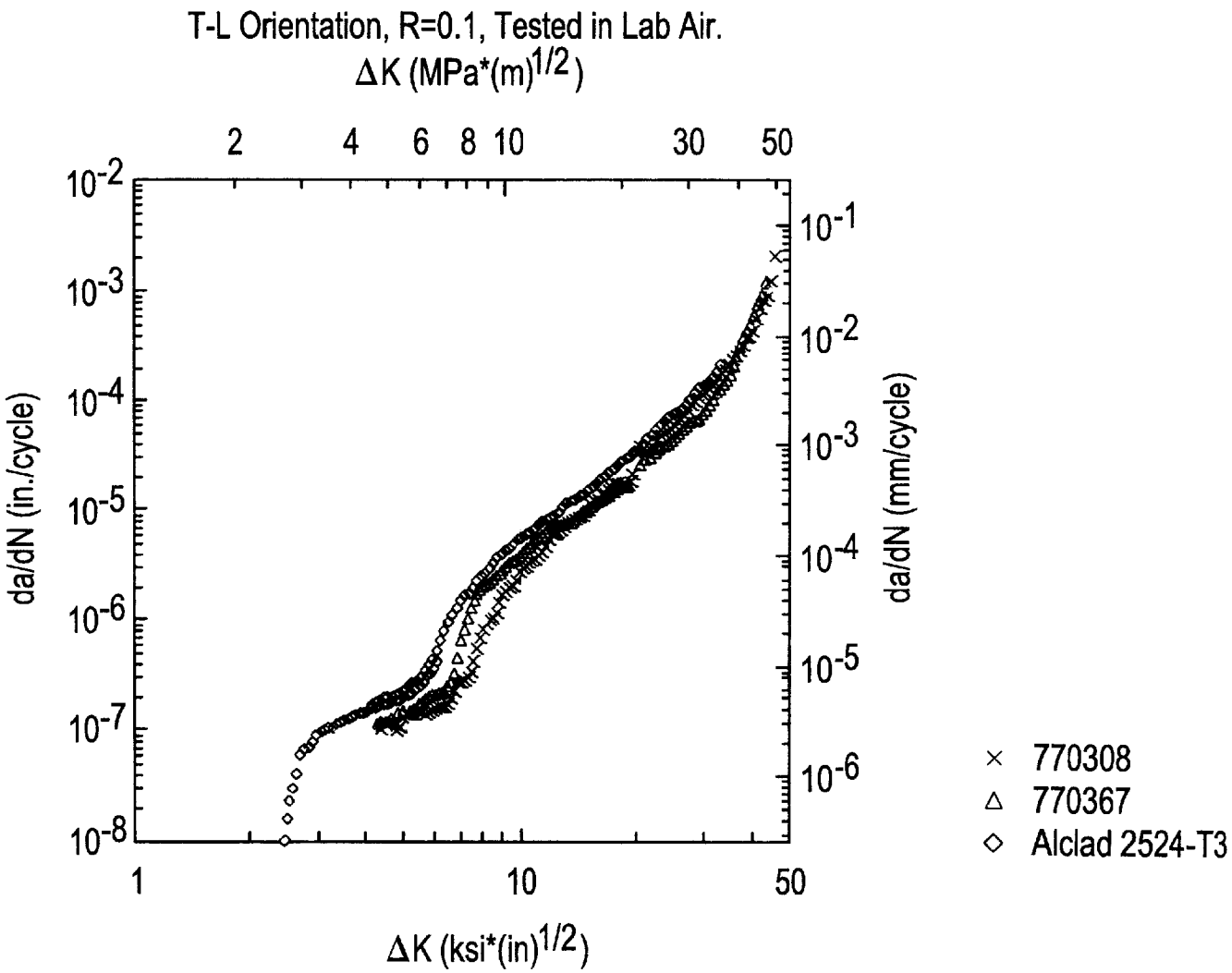
FIG. 16 is a graph illustrating fatigue test results for two of the present alloys exhibiting unrecrystallized microstructures.

Fatigue testing under constant amplitude is shown in FIG. 16. These tests were conducted in samples that appeared to be most promising from the strength and toughness tests. These results revealed that the products made according to the present invention exhibit substantially lower rates of crack growth, i.e., improved resistance to fatigue crack growth.

Figure 17:
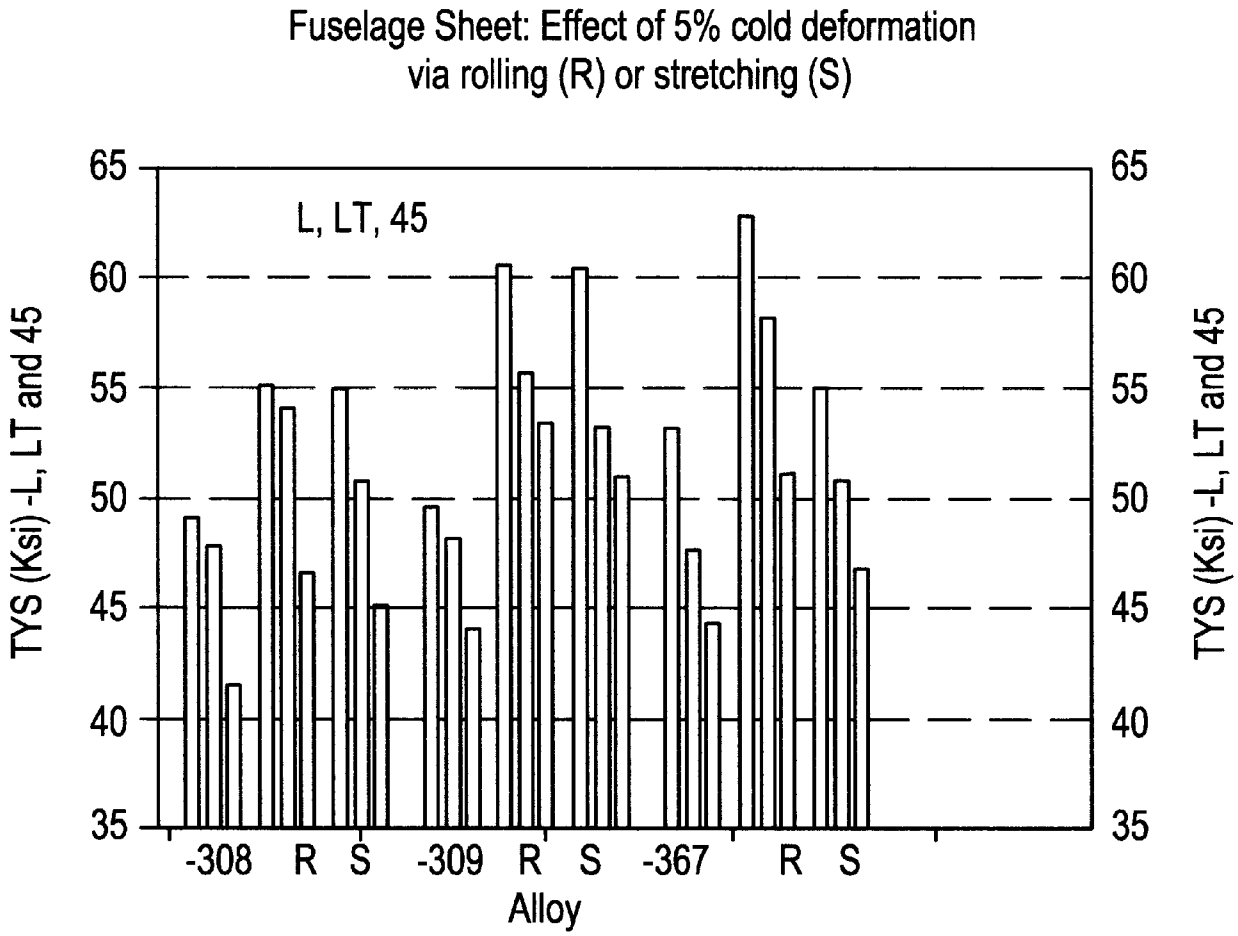
FIG. 17 is a graph illustrating tensile yield strengths for sheet samples of the present invention in different orientations.
Figure 18:
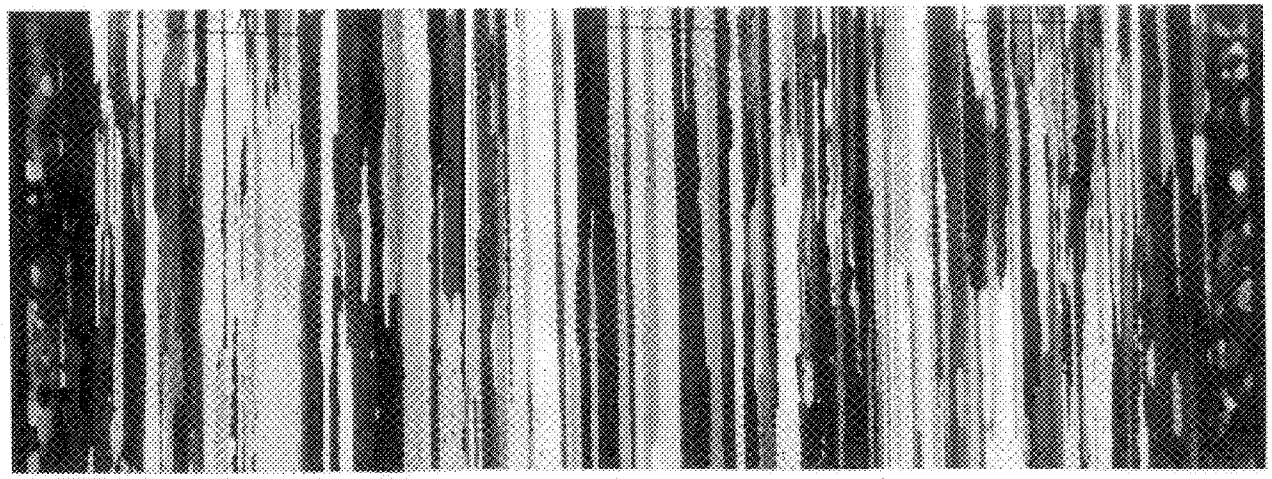
FIG. 18 is a photomicrograph illustrating the anisotropic microstructure of an aluminum sheet product produced in accordance with an embodiment of the present invention.
Figure 19:
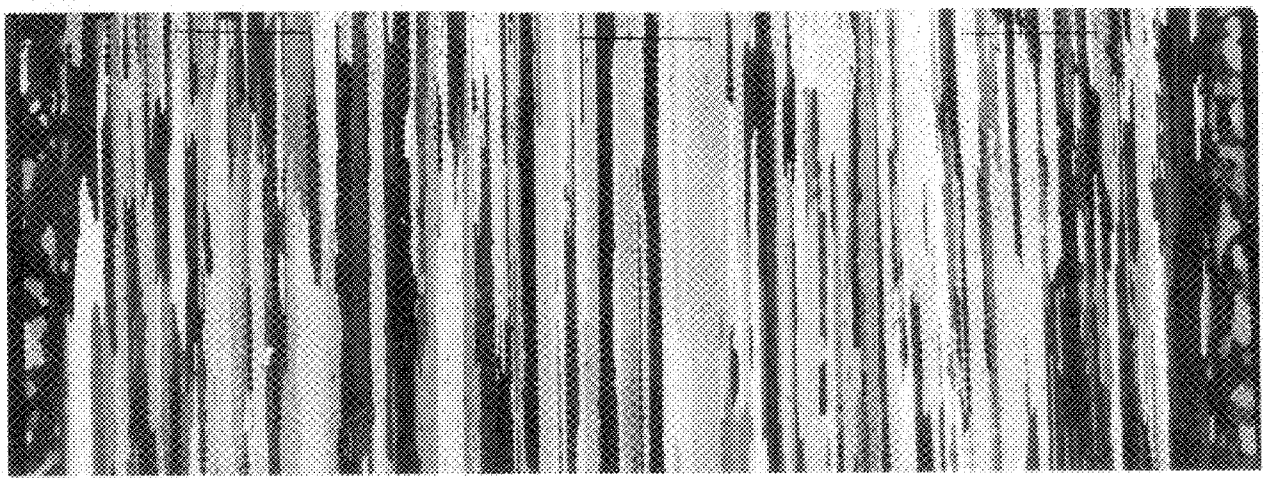
FIG. 19 is a photomicrograph illustrating the anisotropic microstructure of another aluminum sheet product produced in accordance with an embodiment of the present invention.
Figure 20:
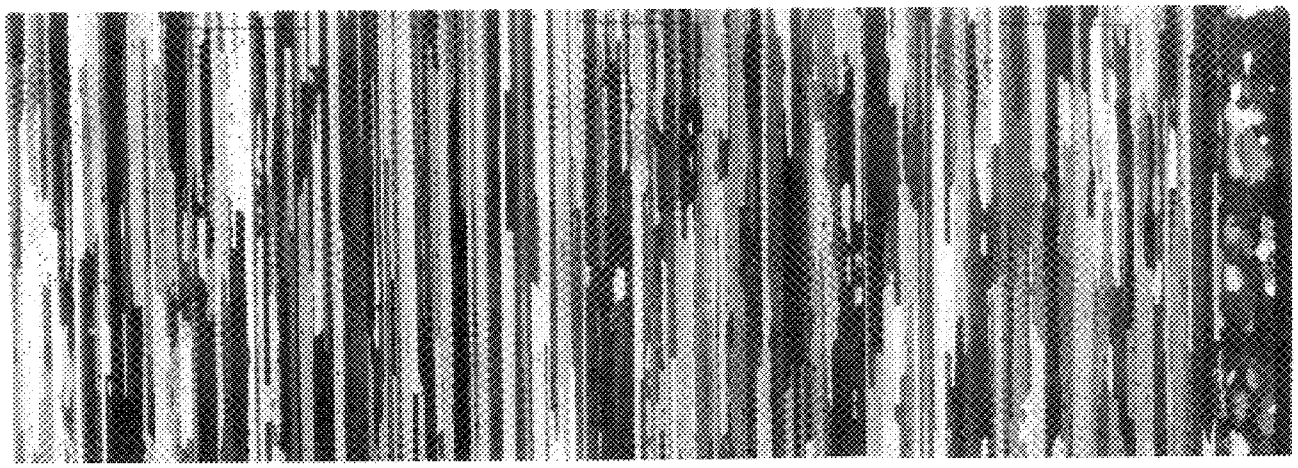
FIG. 20 is a photomicrograph illustrating the anisotropic microstructure of a further aluminum sheet product used in accordance with an embodiment of the present invention.
Figure 21:
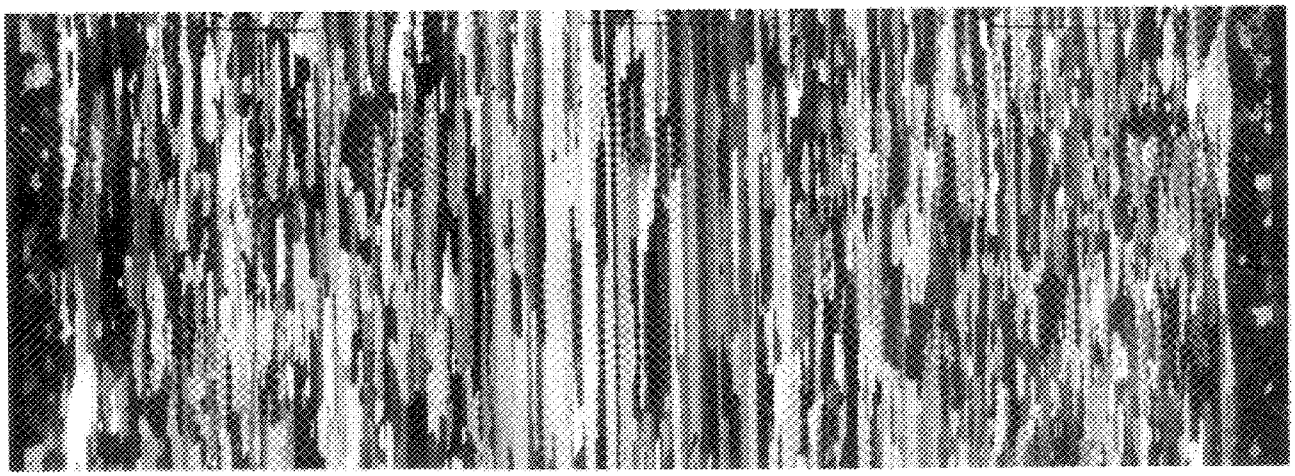
FIG. 21 is a photomicrograph illustrating the anisotropic microstructure of another aluminum sheet product produced in accordance with an embodiment of the present invention.

Samples in the T36 temper exhibited the properties shown in FIG. 17. In FIG. 17, the T36 temper was attained by providing 5 percent cold deformation either via cold rolling or stretching. The strengths of the cold rolled samples are slightly higher.

The results from the foregoing tests revealed that the strength and the resistance to fatigue crack growth were substantially improved in accordance with the present invention. By hot rolling at relatively high temperatures using recovery anneals and by adding Zr and/or Sc as dispersoid forming additions, it was possible to fabricate unrecrystallized microstructures in sheet gauges. The Li additions also appear to aid in the attainment of the unrecrystallized microstructures for unknown reasons. In 2xxx alloys, copper appears to have a substantial effect on strengthening. Scandium additions help attain unrecrystallized microstructures but may be. detrimental for strengthening. Manganese additions are beneficial for strength properties. Cold rolling, e.g., 5 percent, increases the strength significantly without a reduction in fatigue or fracture toughness, this also was a surprise. Alloys containing Li may exhibit larger improvements in properties as a result of the cold deformation than alloys without the Li addition.

A plant rolling trial was performed with the object of producing an anisotropic grain microstructure in a sheet product to exhibit higher strength and higher resistance to the propagation of fatigue cracks. The alloys shown in Table 2 were cast as 15,000 lb ingots and fabricated in accordance with the methods of the present invention, using a fabrication route similar to that shown in FIG. 2.

TABLE 2

| | Sheet Product Alloy Compositions (Weight Percent) | | | | | | |
|---|---|---|---|---|---|---|---|
| Alloy Sample No. | Cu | Mn | Mg | Zr | Fe | Si | Al |
| 354-371 (low Cu-low Mn) | 4.08 | 0.29 | 1.36 | 0.12 | 0.02 | 0.01 | balance |
| 354-381 (high Cu-low Mn) | 4.33 | 0.30 | 1.38 | 0.10 | 0.01 | 0.00 | balance |
| 354-391 (low Cu-high Mn) | 4.09 | 0.58 | 1.35 | 0.11 | 0.02 | 0.01 | balance |
| 354-401 (high Cu-high Mn) | 4.22 | 0.60 | 1.32 | 0.10 | 0.01 | 0.01 | balance |

The sheet products having compositions listed in Table 2 were made as follows. Ingots measuring 14 inches×74 inches×180 inches were cast using direct chill (DC) molds. The compositions reported in Table 2 were measured from metal samples obtained during casting. Ingots were first stress relieved by heating to 750° F. for 6 hours. The ingots were then scalped to remove 0.50 inch surface layer from both rolling surfaces. For preheating, ingots were heated to 850° F., soaked for 2 hours, then heated to 875° F. and soaked an additional 2 hours. Ingots taken from the preheating furnace were roll bonded to alcald 1100 plate and rolled to 6.24 inch gauge. The alcald 6.24 inch slab was reheated to 915° F. for 8 hours, table cooled to 850° F. and hot rolled to 0.180 inch gauge. Metal temperature was kept above 600° F. After hot rolling, the sheet product was given a recrystallization anneal at 700° F. for 8 hours prior to solution heat treatment. The sheet product was batch solution heat treated at 925° F. for 1 minutes. and water quenched. Sheet was flattened with a gauge reduction from 0.180 inch to 0.17746 inch. Then T3 and T36 tempers were fabricated. The aluminum cladding had a thickness of 2.5 percent of the final thickness. The anisotropic microstructures comprising elongated recrystallized grains attained in the final T3 temper are shown in FIGS. 18–21.

Figure 22:
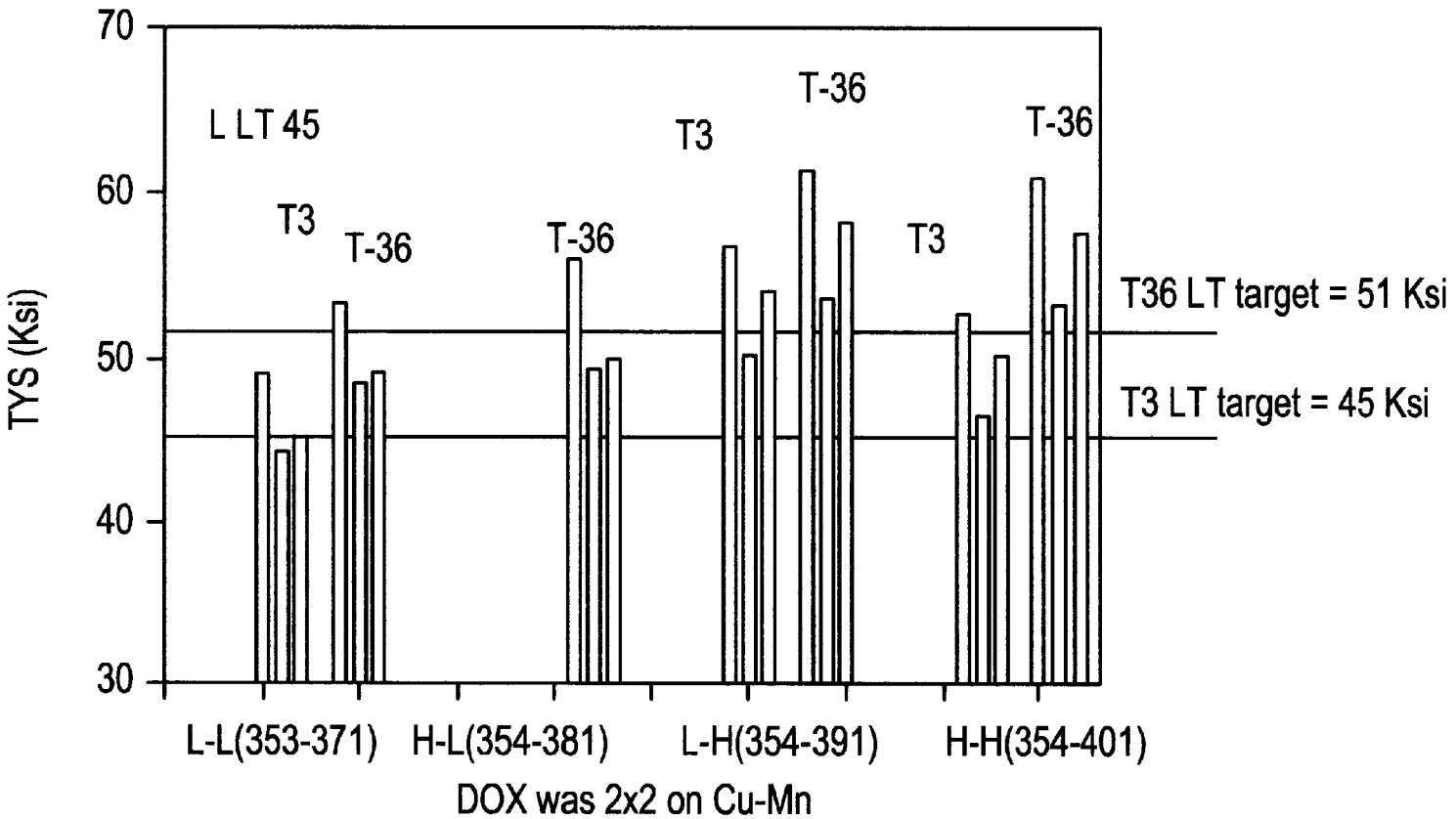
FIG. 22 is a graph illustrating tensile yield strength values for sheet products of the present invention in different orientations.
Figure 23:
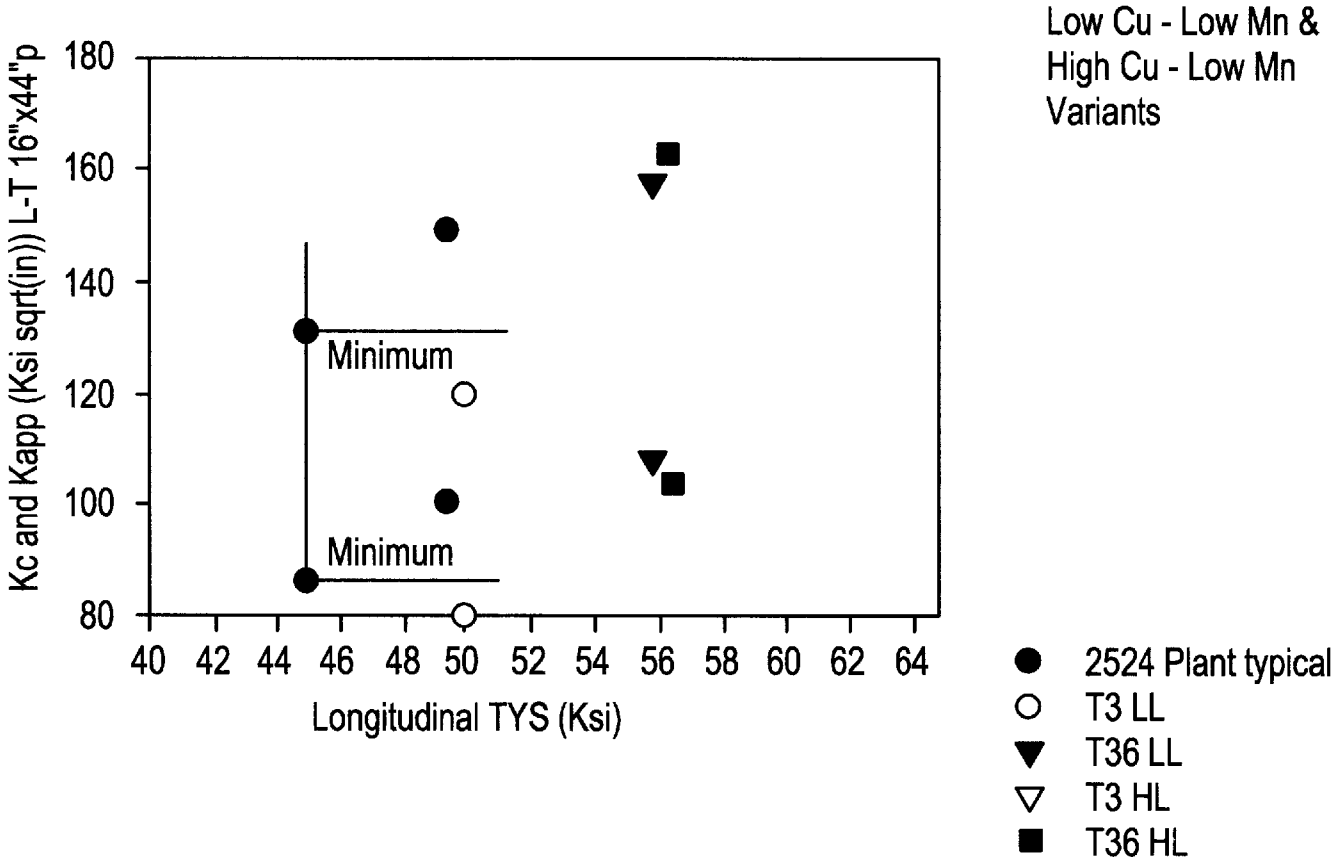
FIGS. 23–26 are graphs illustrating fracture toughness and tensile yield strength values for sheet products produced in accordance with embodiments of the present invention.
Figure 24:
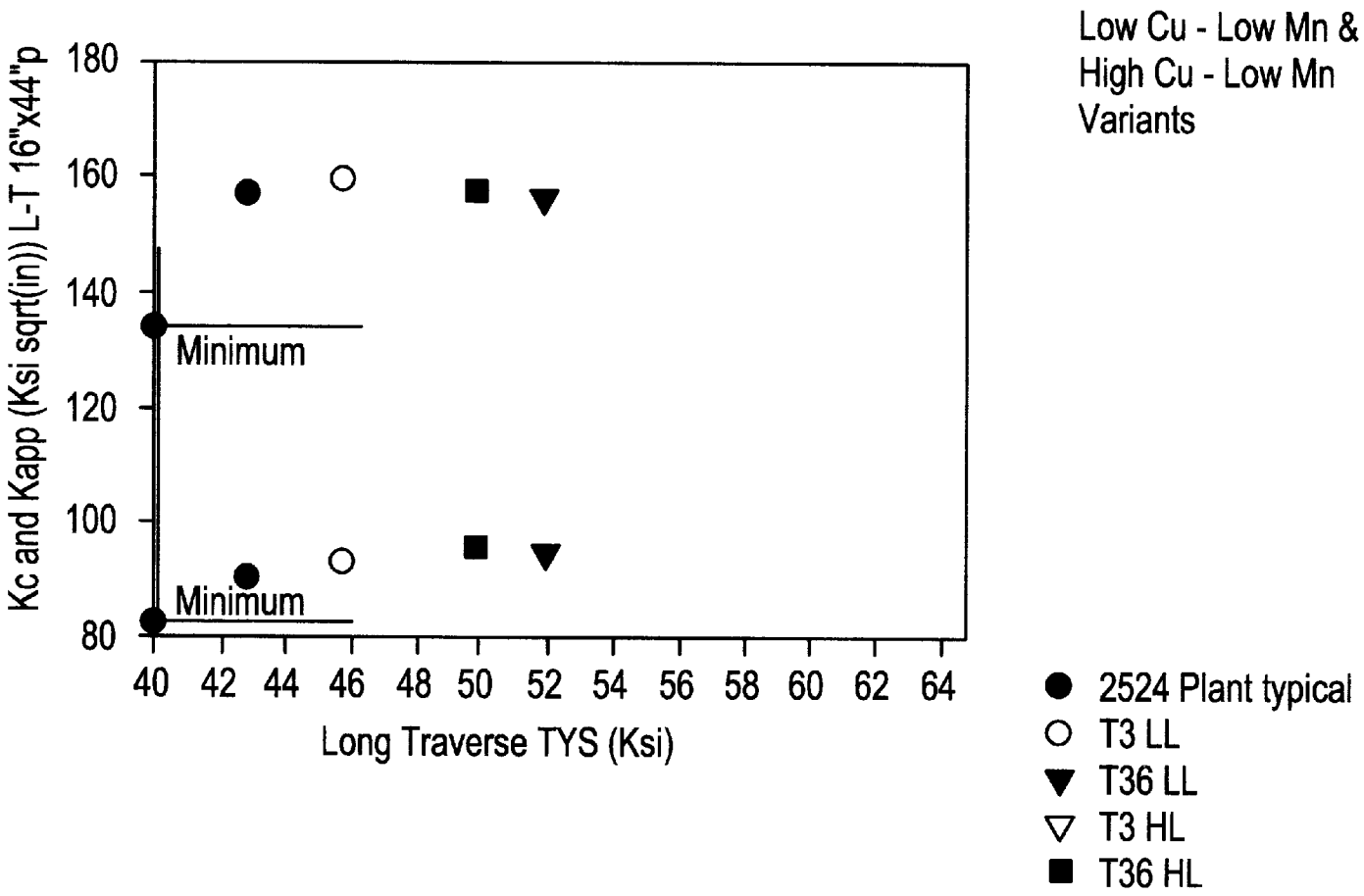
Figure 25:
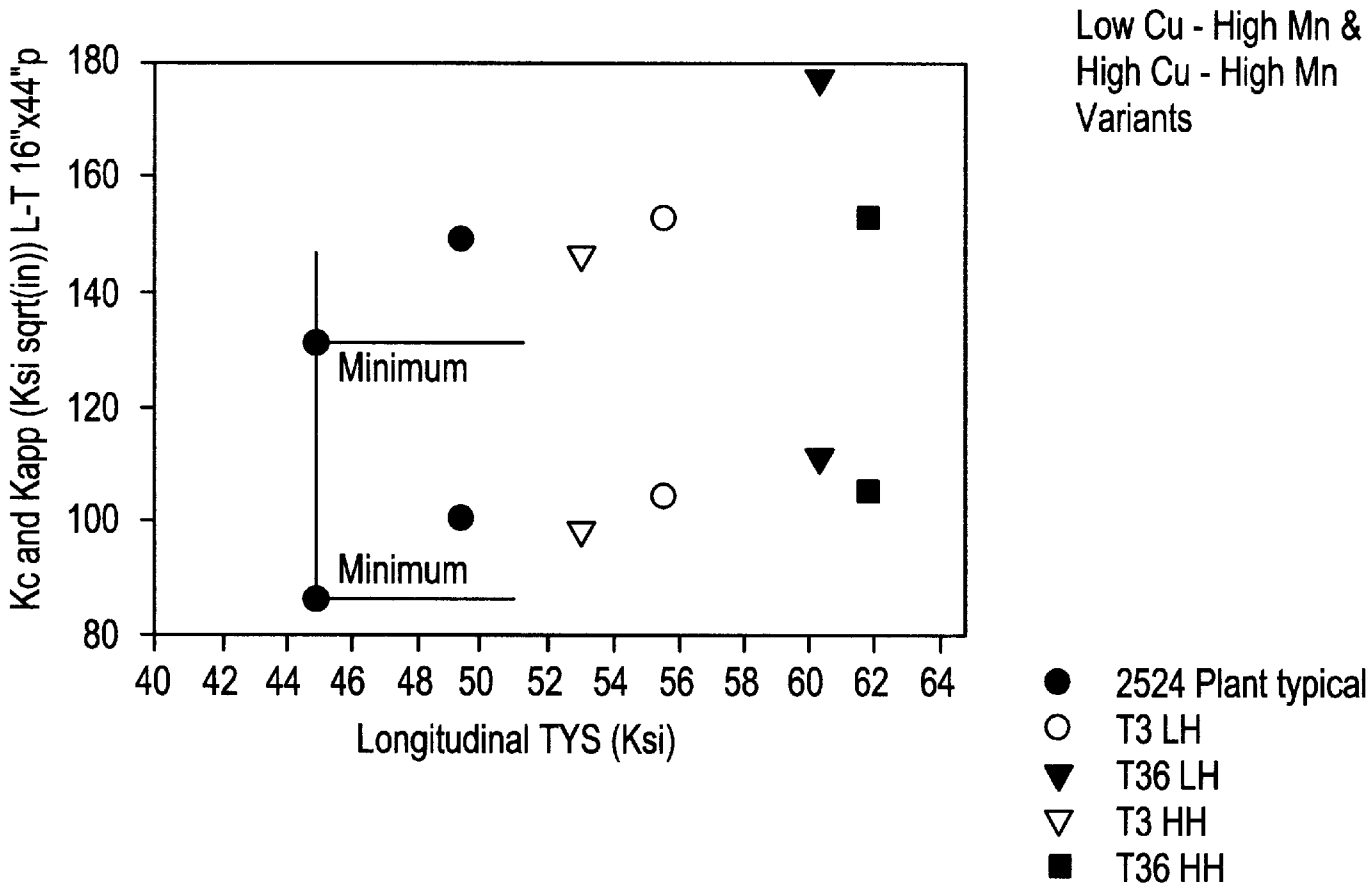
Figure 26:
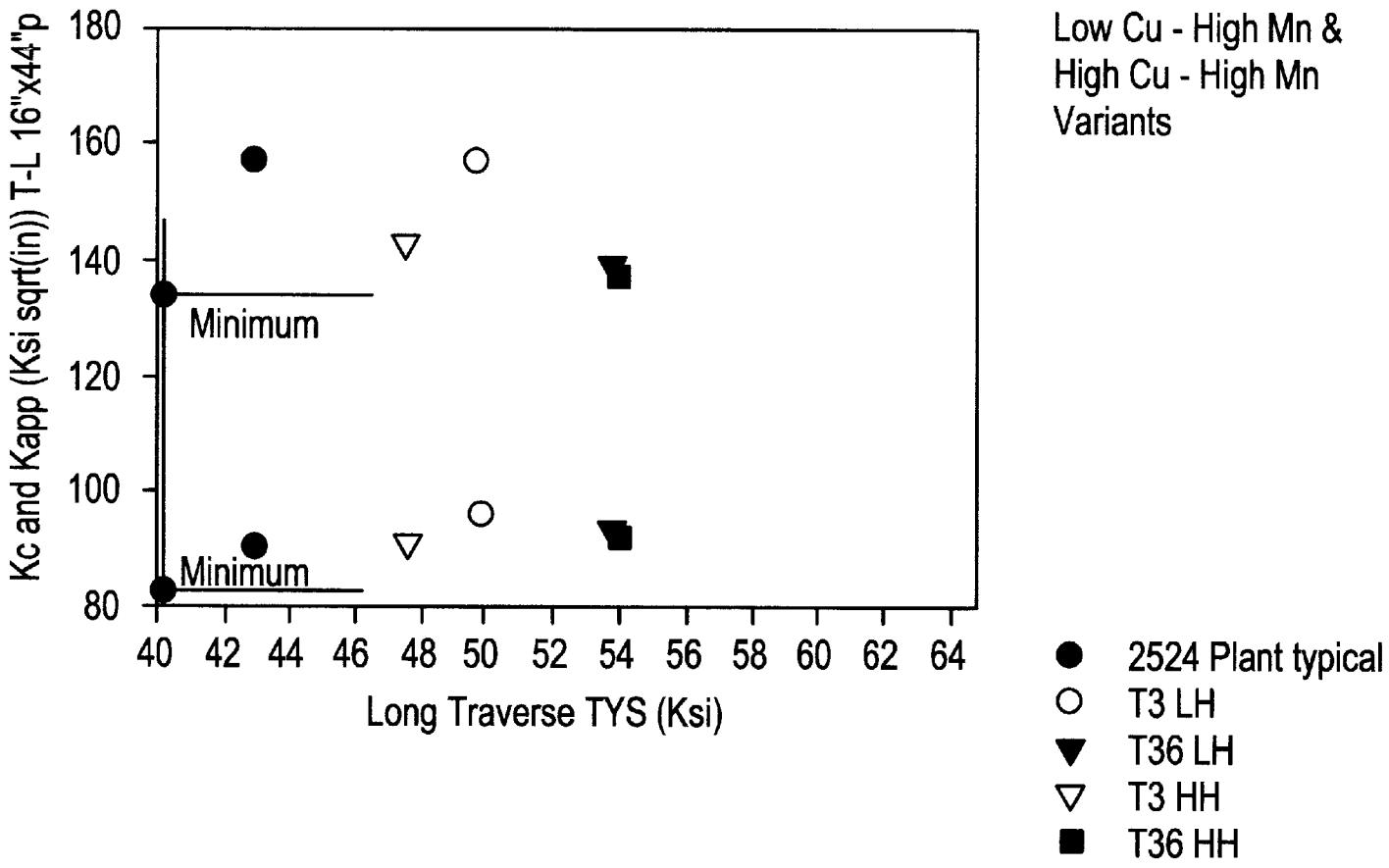

Results from tensile strength measurements are shown in FIG. 22. Measurements of tensile properties indicated that the high Mn variants listed in Table 2 exhibited higher strengths than the low Mn variants. The strengthening effect of Mn was surprisingly higher than that of Cu.

Fracture toughness measurements were conducted using 16 inch by 44 inch center notch toughness specimens. Results from strength and toughness measurements are shown in FIGS. 23 to 26. These figures also show an average value for 2524-T3 alclad sheet for comparison purposes. The minimum values shown in these figures correspond to a minus 3 times the standard deviation extrapolated value. The strength and toughness combinations of the sheet products with high Mn variants are better than those of 2524-T3. Surprisingly, the low Cu-high Mn sample exhibits higher properties than the high Cu-low Mn sample.

Figure 27:
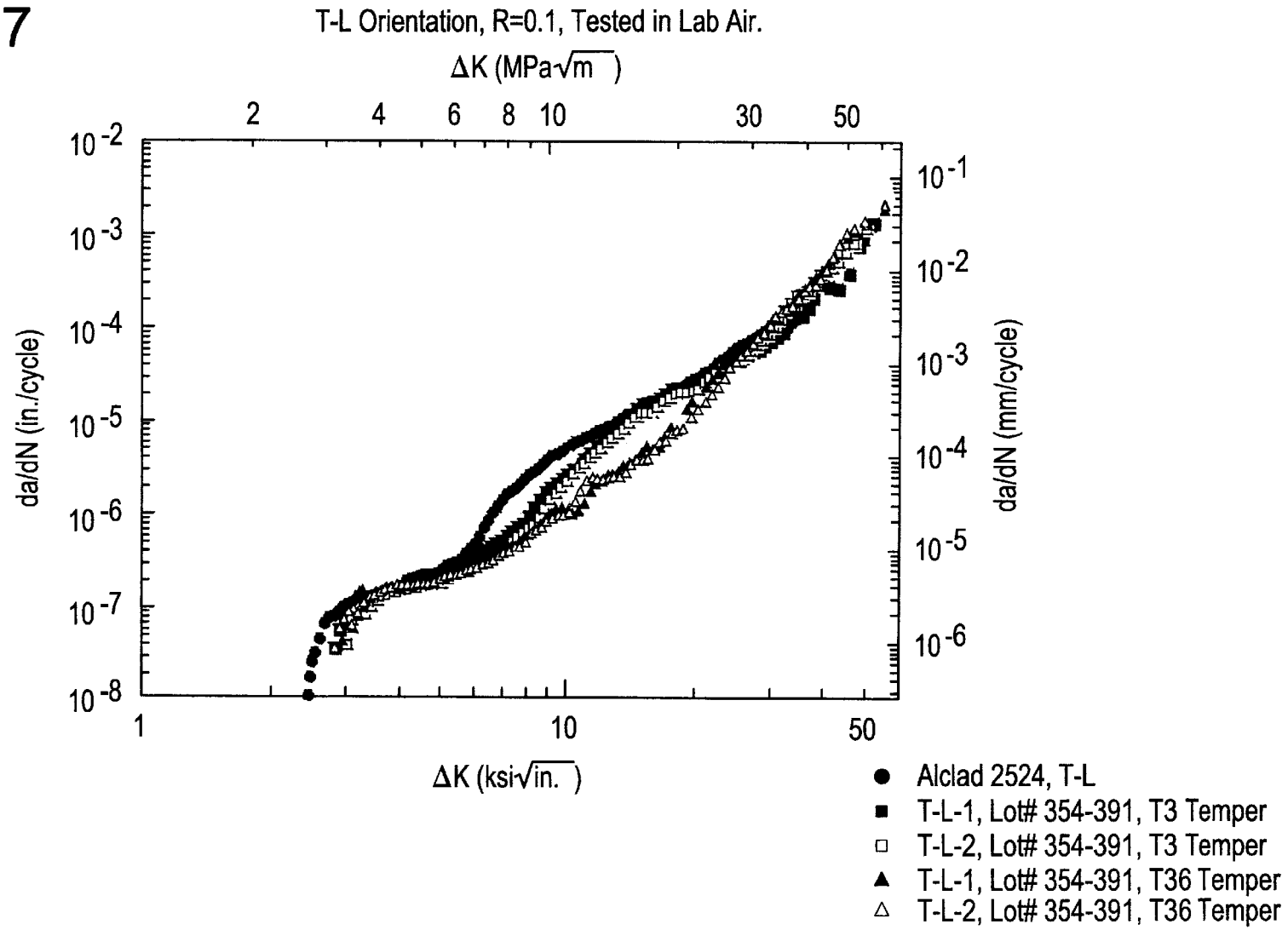
FIG. 27 is a graph illustrating duplicate fatigue test results for two alclad alloys exhibiting elongated recrystallized grains.

FIG. 27 shows the da/dN performance of the low Cu-high Mn variant for the T3 and T36 tempers. The tests were conducted in duplicate and resulted in good correlation from the duplicate tests. Note that these results indicate that, at a delta K of 10, the. rate of growth of fatigue cracks is reduced for the T3 tempers and reduced even more for the T36 tempers. These results indicate that the products fabricated in accordance with the present invention exhibit better FCG performance.

Figure 28:
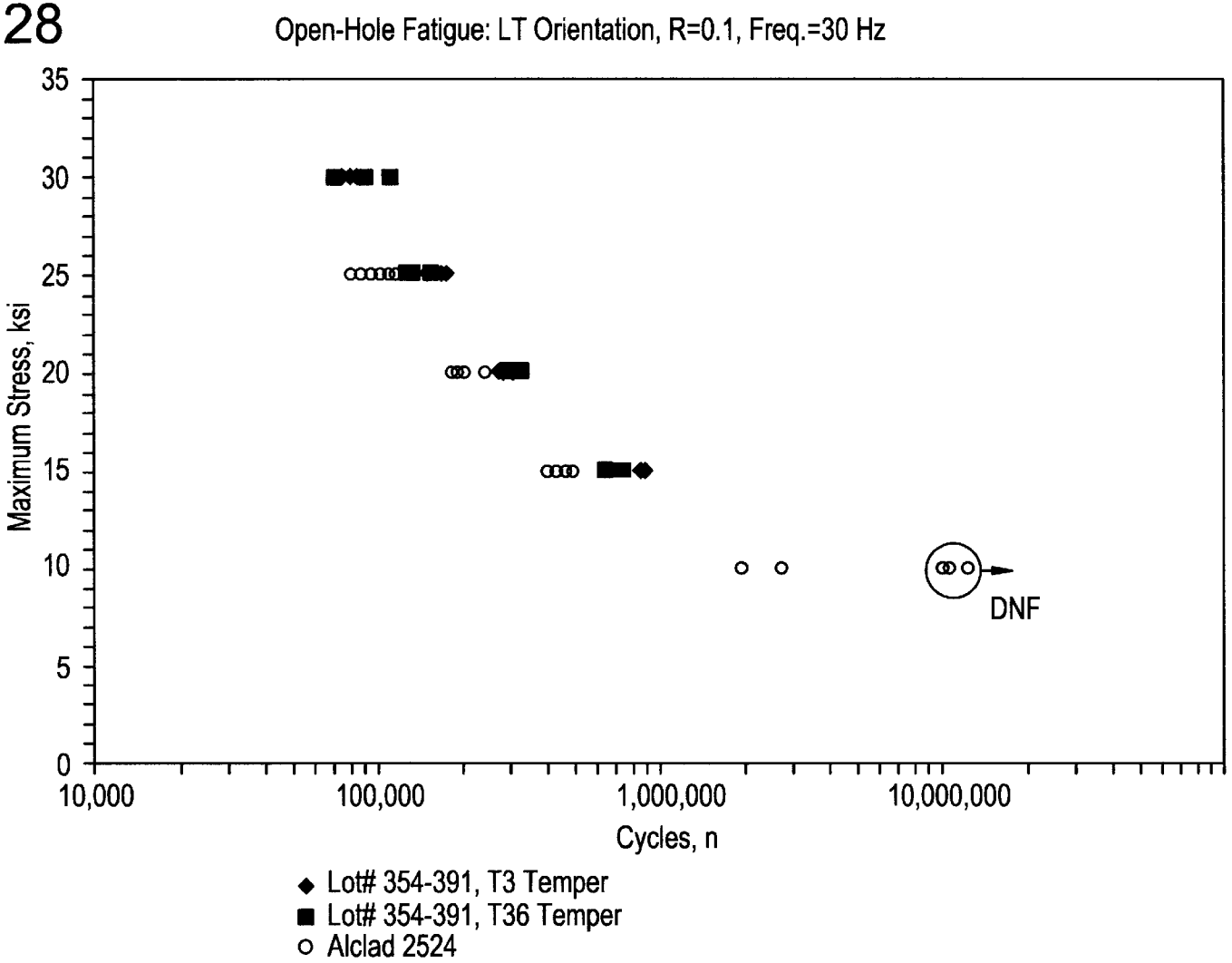
FIG. 28 is a graph illustrating results from S/N fatigue testing for two alclad alloys exhibiting elongated recrystallized grains.

FIG. 28 shows results from the testing of S/N fatigue. Note that for a given value of the number of cycles, the maximum stress is higher for products fabricated in accordance with the present invention. This means that components can be subjected to higher stresses than conventional components to experience the same life. The S/N fatigue performance of the products fabricated in accordance with this invention is also better than that of alclad 2524-T3 sheet product.

Table 3 shows the results from compressive yield strength tests, in which compressive strength properties in the longitudinal (L) and long transverse (LT) orientations for alloy 2524 and one of the alloys of the present invention (the low Cu-high Mn variant 354-391) are compared. A significant improvement in compressive yield strength properties is achieved by the present sheet products in comparison with the conventional 2524 sheet product.

TABLE 3

| Measured Compressive Yield Strengths for Alloy 2524 and 354-391 Low Cu-High Mn | | | |
|---|---|---|---|
| Gauge | L (ksi) | LT (ksi) | Temper |
| | 2524-T3 Measurements | | |
| 0.200 | 42.8 | 49.3 | T3 |
| 0.200 | 43.0 | 48.4 | T3 |
| 0.249 | 42.9 | 48.7 | T3 |
| 0.249 | 42.2 | 47.3 | T3 |
| 0.249 | 42.5 | 48.5 | T3 |
| 0.249 | 43.7 | 49.2 | T3 |
| 0.310 | 40.9 | 44.4 | T3 |
| MLHDBK5 | 39.0 | 43.0 | T3 |
| | 354-391 Measurements | | |
| 0.177 | 51.5 | 54.8 | T3 |
| 0.177 | 51.5 | 56.2 | T3 |
| 0.177 | 54.1 | 60.5 | T36 |
| 0.177 | 55.2 | 62.1 | T36 |

The anisotropic microstructures of some recrystallized and unrecrystallized sheet products of the present invention were measured in comparison with conventional alloy 2024 and 2524 sheet products. Table 4 lists the Brass and Goss texture components of 2024-T3 and 2524-T4 sheet products in 0.0125 inch gauges. These are compared with the 770-309 and 770-311 unrecrystallized sheet products of the present invention listed in Table 1, and the 354-391 and 354401 recrystallized sheet products of the present invention listed in Table 2.

TABLE 4

Maximum Intensity of Texture Components (X Times Random)

| Alloy | Microstructure | Brass | Goss |
|---|---|---|---|
| 2024-T3 | recrystallized equiaxed grains | 1.0 | 12.0 |
| 2524-T4 | recrystallized equiaxed grains | 1.9 | 15.3 |
| 770-309 | unrecrystallized elongated grains | 36.1 | 0 |
| 770-311 | unrecrystallized elongated grains | 34.9 | 0 |
| 354-391 | recrystallized elongated grains | 1.3 | 42.7 |
| 354-401 | recrystallized elongated grains | 8.6 | 56.7 |

As shown in Table 4, the unrecrystallized sheet samples 770-309 and 770-311 of the present invention possess Brass texture components of greater than 30, indicating their highly anisotropic microstructures The recrystallized sheet samples 354-391 and 354-401 of the present invention possess Goss texture components of greater than 40, well above the Goss texture components of the conventional 2024-T3 and 2524-T4 recrystallized sheet products.

The products and methods of the present invention provide several advantages over conventionally fabricated aluminum products. In accordance with the present invention, aluminum sheet products containing high anisotropy in grain microstructure are provided which exhibit high fracture surface roughness and secondary cracking and branching, making the products better suited for applications requiring low fatigue crack growth. In addition, the products exhibit favorable combinations of strength and fracture toughness.

Whereas particular embodiments of this invention have been described above for purposes of illustration, it will be evident to those skilled in the art that numerous variations of the details of the present invention may be made without departing from the invention as defined in the appended claims.

What is claimed is:

1. A rolled aluminum alloy sheet product comprising an anisotropic microstructure defined by grains having an average length to width aspect ratio of greater than about 4 to 1, wherein the sheet product comprises unrecrystallized grains having a Brass texture of greater than 20 and/or recrystallized grains having a Goss texture of greater than 20, and the aluminum alloy is substantially free of Li, comprises a maximum of 0.7 weight percent Mn and comprises a maximum of 0.2 weight percent Si.

2. The rolled aluminum alloy sheet product of claim 1, wherein the aluminum alloy is an Al—Cu base alloy comprising aluminum, from about 1 to about 5 weight percent Cu, up to about 6 weight percent Mg, and up to about 0.5 weight percent Zr.

3. The rolled aluminum alloy sheet product of claim 2, wherein the Al—Cu base alloy comprises at least about 3 weight percent Cu.

4. The rolled aluminum alloy sheet product of claim 2, wherein the Al—Cu base alloy includes from about 3.5 to about 4.5 weight percent Cu, from about 0.6 to about 1.6 weight percent Mg, from about 0.3 to about 0.7 weight percent Mn, and from about 0.08 to about 0.13 weight percent Zr.

5. The rolled aluminum alloy sheet product of claim 2, wherein the Al—Cu base alloy includes from about 3.8 to about 4.4 weight .percent Cu, from about 0.3 to about 0.7 weight percent Mn, from about 1.0 to about 1.6 weight percent Mg, and from about 0.09 to about 0.12 weight percent Zr.

6. The rolled aluminum alloy sheet product of claim 2, wherein the Al—Cu base alloy includes from about 3.4 to about 4.0 weight percent Cu, from 0 to about 0.4 weight percent Mn, from about 1.0 to about 1.6 weight percent Mg, and from about 0.09 to about 0.12 weight percent Zr.

7. The rolled aluminum alloy sheet product of claim 2, wherein the Al—Cu base alloy includes from about 3.2 to about 3.8 weight percent Cu, from about 0.3 to about 0.7 weight percent Mn, from about 1.0 to about 1.6 weight percent Mg, from about 0.09 to about 0.12 weight percent Zr, and from about 0.25 to about 0.75 weight percent Li.

8. The rolled aluminum alloy sheet product of claim 2, wherein the Al—Cu base alloy further comprises up to about 1 weight percent of at least one element selected from Zn or Ag.

9. The rolled aluminum alloy sheet product of claim 2, wherein the Al—Cu base alloy further comprises up to about 1 weight percent of at least one element selected from Hf or Sc.

10. The rolled aluminum alloy sheet product of claim 2, wherein the Al—Cu base alloy further comprises up to about 1 weight percent of at least one element selected from Cr, V, Ni or Fe.

11. The rolled aluminum alloy sheet product of claim 1, wherein the aluminum alloy is an Al—Mg base alloy comprising aluminum, from about 0.2 to about 7 weight percent Mg, from 0 to about 1.5 weight percent Cu, and from 0 to about 3 weight percent Zn.

12. The rolled aluminum alloy sheet product of claim 11, wherein the Al—Mg base alloy further comprises up to about 1 weight percent of at least one alloying addition selected from Ag, Cd, lanthanides, Cr, Fe, Ni, Sc, Hf, Ti, V or Zr.

13. The rolled aluminum alloy sheet product of claim 1, wherein the aluminum alloy is an Al—Zn base alloy comprising aluminum, from about 1 to about 10 weight percent Zn, from about 0.1 to about 3 weight percent Cu, from about 0.1 to about 3 weight percent Mg, and from about 0 to about 2 weight percent Ag.

14. The rolled aluminum alloy sheet product of claim 13, wherein the Al—Zn base alloy further comprises up to about 1 weight percent alloying additions selected from Cd, lanthanides, Mn, Cr, Ni, Fe, Sc, Hf, Ti, V or Zr.

15. The rolled aluminum alloy sheet product of claim 1, wherein the aspect ratio is greater than about 6 to 1.

16. The rolled aluminum alloy sheet product of claim 1, wherein the aspect ratio is greater than about 8 to 1.

17. The rolled aluminum alloy sheet product of claim 1, wherein the aspect ratio is greater than about 10 to 1.

18. The rolled aluminum alloy sheet product of claim 1, wherein the sheet product is unrecrystallized.

19. The rolled aluminum alloy sheet product of claim 18, wherein the unrecrystallized sheet product has a Brass texture of greater than 20.

20. The rolled aluminum alloy sheet product of claim 18, wherein the unrecrystallized sheet product has a Brass texture of greater than 30.

21. The rolled aluminum alloy sheet product of claim 18, wherein the unrecrystallized sheet product has a Brass texture of greater than 40.

22. The rolled aluminum alloy sheet product of claim 1, wherein the sheet product is recrystallized.

23. The rolled aluminum alloy sheet product of claim 22, wherein the recrystallized sheet product has a Goss texture of greater than 20.

24. The rolled aluminum alloy sheet product of claim 22, wherein the recrystallized sheet product has a Goss texture of greater than 30.

25. The rolled aluminum alloy sheet product of claim 22, wherein the recrystallized sheet product has a Goss texture of greater than 40.

26. The rolled aluminum alloy sheet product of claim 1, wherein the sheet product has a thickness of up to about 0.35 inch.

27. The rolled aluminum alloy sheet product of claim 1, wherein the sheet product has a thickness of up to about 0.325 inch.

28. The rolled aluminum alloy sheet product of claim 1, wherein the sheet product has a thickness of up to about 0.3 inch.

29. The rolled aluminum alloy sheet product of claim 1, wherein the sheet product has a thickness of up to about 0.25 inch.

30. The rolled aluminum alloy sheet product of claim 1, wherein the sheet product has a thickness of up to about 0.2 inch.

31. The rolled aluminum alloy sheet product of claim 1, wherein the sheet product includes at least one cladding layer.

32. The rolled aluminum alloy sheet product of claim 31, wherein the at least one cladding layer has a thickness of from about 1 to about 5 percent of the thickness of the sheet product.

33. The rolled aluminum alloy sheet product of claim 1, wherein the sheet product has been recovery annealed.

34. The rolled aluminum alloy sheet product of claim 33, wherein the sheet product has further been solution heat treated after the recovery anneal.

35. The rolled aluminum alloy sheet product of claim 1, wherein the sheet product has been solution heat treated and subsequently cold worked.

36. The rolled aluminum alloy sheet product of claim 35, wherein the sheet product has further been recovery annealed prior to the solution heat treatment.

37. An Al—Cu base alloy sheet product comprising aluminum, from about 1 to about 5 weight percent Cu, up to about 6 weight percent Mg, up to about 0.7 weight percent Mn, up to about 0.5 weight percent Zr, up to about 0.2 weight percent Si, and substantially free of Li, wherein the sheet product comprises an anisotropic microstructure defined by grains having an average length to width aspect ratio of greater than about 4 to 1, and wherein the sheet product comprises unrecrystallized grains having a Brass texture of greater than 20 and/or recrystallized grains having a Goss textur of greater than 20.

38. The Al—Cu base alloy sheet product of claim 37, wherein the Al—Cu base alloy comprises at least about 3 weight percent Cu.

39. The Al—Cu base alloy sheet product of claim 37, wherein the Al—Cu base alloy includes from about 3.5 to about 4.5 weight percent Cu, from about 0.6 to about 1.6 weight percent Mg, from about 0.3 to about 0.7 weight percent Mn, and from about 0.08 to about 0.13 weight percent Zr.

40. The Al—Cu base alloy sheet product of claim 37, wherein the Al—Cu base alloy includes from about 3.8 to about 4.4 weight percent Cu, from about 0.3 to about 0.7 weight percent Mn, from about 1.0 to about 1.6 weight percent Mg, and from about 0.09 to about 0.12 weight percent Zr.

41. The Al—Cu base alloy sheet product of claim 37, wherein the Al—Cu base alloy includes from about 3.4 to about 4.0 weight percent Cu, from 0 to about 0.4 weight percent Mn, from about 1.0 to about 1.6 weight percent Mg, and from about 0.09 to about 0.12 weight percent Zr.

42. The Al—Cu base alloy sheet product of claim 37, wherein the Al—Cu base alloy includes from about 3.2 to about 3.8 weight percent Cu, from about 0.3 to about 0.7 weight percent Mn, from about 1.0 to about 1.6 weight percent Mg, and from about 0.09 to about 0.12 weight percent Zr.

43. The Al—Cu base alloy sheet product of claim 37, wherein the Al—Cu base alloy further comprises up to about 1 weight percent of at least one element selected from Zn or Ag.

44. The Al—Cu base alloy sheet product of claim 37, wherein the Al—Cu base alloy further comprises up to about 1 weight percent of at least one element selected from Hf or Sc.

45. The Al—Cu base alloy sheet product of claim 37, wherein the Al—Cu base alloy further comprises up to about 1 weight percent of at least one element selected from Cr, V, Mn, Ni or Fe.

46. The Al—Cu base alloy sheet product of claim 37, wherein the aspect ratio is greater than about 6 to 1.

47. The Al—Cu base alloy sheet product of claim 37, wherein the aspect ratio is greater than about 8 to 1.

48. The Al—Cu base alloy sheet product of claim 37, wherein the aspect ratio is greater than about 10 to 1.

49. The Al—Cu base alloy sheet product of claim 37, wherein the sheet product is unrecrystallized.

50. The Al—Cu base alloy sheet product of claim 49, wherein the unrecrystallized sheet product has a Brass texture of greater than 20.

51. The Al—Cu base alloy sheet product of claim 49, wherein the unrecrystallized sheet product has a Brass texture of greater than 30.

52. The Al—Cu base alloy sheet product of claim 49, wherein the unrecrystallized sheet product has a Brass texture of greater than 40.

53. The Al—Cu base alloy sheet product of claim 37, wherein the sheet product is recrystallized.

54. The Al—Cu base alloy sheet product of claim 53, wherein the recrystallized sheet product has a Goss texture of greater than 20.

55. The Al—Cu base alloy sheet product of claim 53, wherein the recrystallized sheet product has a Goss texture of greater than 30.

56. The Al—Cu base alloy sheet product of claim 53, wherein the recrystallized sheet product has a Goss texture of greater than 40.

57. The Al—Cu base alloy sheet product of claim 37, wherein the sheet product has a thickness of up to about 0.35 inch.

58. The Al—Cu base alloy sheet product of claim 37, wherein the sheet product has a thickness of up to about 0.325 inch.

59. The Al—Cu base alloy sheet product of claim 37, wherein the sheet product has a thickness of up to about 0.3 inch.

60. The Al—Cu base alloy sheet product of claim 37, wherein the sheet product has a thickness of up to about 0.25 inch.

61. The Al—Cu base alloy sheet product of claim 37, wherein the sheet product has a thickness of up to about 0.2 inch.

62. The Al—Cu base alloy sheet product of claim 37, wherein the sheet product includes at least one cladding layer.

63. The Al—Cu base alloy sheet product of claim 62, wherein the at least one cladding layer has a thickness of from about 1 to about 5 percent of the thickness of the sheet product.

64. The Al—Cu base alloy sheet product of claim 37, wherein the sheet in a T3 temper exhibits a T-L orientation fatigue crack growth rate da/dN of less than about $5\times10^{-6}$ inch/cycle at a ΔK of 10 ksi√inch.

65. The Al—Cu base alloy sheet product of claim 37, wherein the sheet in a T3 temper exhibits a T-L orientation fatigue crack growth rate da/dN of less than about $4\times10^{-6}$ inch/cycle at a ΔK of 10 ksi√inch.

66. The Al—Cu base alloy sheet product of claim 37, wherein the sheet in a T3 temper exhibits a T-L orientation fatigue crack growth rate da/dN of less than about $3\times10^{-6}$ inch/cycle at a ΔK of 10 ksi√inch.

67. The Al—Cu base alloy sheet product of claim 37, wherein the sheet in a T36 temper exhibits a T-L orientation fatigue crack growth rate da/dN of less than about $4\times10^{-6}$ inch/cycle at a ΔK of 10 ksi√inch.

68. The Al—Cu base alloy sheet product of claim 37, wherein the sheet in a T36 temper exhibits a T-L orientation fatigue crack growth rate da/dN of less than about $3\times10^{-6}$ inch/cycle at a ΔK of 10 ksi√inch.

69. The Al—Cu base alloy sheet product of claim 37, wherein the sheet in a T36 temper exhibits a T-L orientation fatigue crack growth rate da/dN of less than about $2\times10^{-6}$ inch/cycle at a ΔK of 10 ksi√inch.

70. The Al—Cu base alloy sheet product of claim 37, wherein the sheet product has a longitudinal tensile yield strength of greater than 45 ksi.

71. The Al—Cu base alloy sheet product of claim 37, wherein the sheet product has a longitudinal tensile yield strength of greater than 48 ksi.

72. The Al—Cu base alloy sheet product of claim 37, wherein the sheet product has a long transverse tensile yield strength of greater than 40 ksi.

73. The Al—Cu base alloy sheet product of claim 37, wherein the sheet product has a long transverse tensile yield strength of greater than 43 ksi.

74. The Al—Cu base alloy sheet product of claim 37, wherein the sheet product has a long transverse $K_c$ fracture toughness of greater than 130 ksi√inch.

75. The Al—Cu base alloy sheet product of claim 37, wherein the sheet product has a long transverse $K_c$ fracture toughness of greater than 140 ksi√inch.

76. The Al—Cu base alloy sheet product of claim 37, wherein the sheet product has a long transverse $K_{app}$ fracture toughness of greater than 85 ksi√inch.

77. The Al—Cu. base alloy sheet product of claim 37, wherein the sheet product has a long transverse $K_{app}$ fracture toughness of greater than 90 ksi√inch.

78. The Al—Cu base alloy sheet product of claim 37, wherein the sheet product has a longitudinal tensile yield strength of greater than 45 ksi and a long transverse $K_c$ fracture toughness of greater than 130 ksi√inch.

79. The Al—Cu base alloy sheet product of claim 37, wherein the sheet product has a longitudinal tensile yield strength of greater than 48 ksi and a long transverse $K_c$ fracture toughness of greater than 140 ksi√inch.

80. The Al—Cu base alloy sheet product of claim 37, wherein the sheet product has been recovery annealed after hot rolling.

81. The Al—Cu base alloy sheet product of claim 80, wherein the sheet product has further been intermediate annealed before the recovery anneal.

82. The Al—Cu base alloy sheet product of claim 81, wherein the sheet product has been intermediate annealed during hot rolling.

83. The Al—Cu base alloy sheet product of claim 81, wherein the sheet product has been cold rolled after hot rolling, and intermediate annealed during cold rolling.

84. The Al—Cu base alloy sheet product of claim 37, wherein the sheet product comprises an aircraft fuselage section.

85. The Al—Cu base alloy sheet product of claim 37, wherein the aluminum alloy comprises a maximum of 4.0 weight percent Cu.

86. An aircraft fuselage sheet comprising a rolled aluminum alloy sheet product comprising an anistropic microstructure defined by grains having an average length to width aspect ratio of greater than about 4 to 1, wherein the sheet product comprises unrecrystallized grains having a Brass texture of greater than 20 and/or recrystallized grains having a Goss texture of greater than 20, and the aluminum alloy is substantially free of Li, comprises a maximum of 0.7 weight percent Mn and composes a maximum of 0.2 weight percent Si.

87. The aircraft fuselage sheet of claim 86, wherein the aluminum alloy is an Al—Cu base alloy comprising aluminum, from about 1 to about 5 weight percent Cu, up to about 6 weight percent Mg, and up to about 0.5 weight percent Zr.

88. The aircraft fuselage sheet of claim 87, wherein the Al—Cu base alloy. comprises at least about 3 weight percent Cu.

89. The aircraft fuselage sheet of claim 88, wherein the Al—Cu base alloy includes from about 3.5 to about 4.5 weight percent Cu, from about 0.6 to about 1.6 weight percent Mg, from about 0.3 to about 0.7 weight percent Mn, and from about 0.08 to about 0.13 weight percent Zr.

90. The aircraft fuselage sheet of claim 87, wherein the Al—Cu base alloy includes from about 3.8 to about 4.4 weight percent Cu, from about 0.3 to about 0.7 weight percent Mn, from about 1.0 to about 1.6 weight percent Mg, and from about 0.09 to about 0.12 weight percent Zr.

91. The aircraft fuselage sheet of claim 87, wherein the Al—Cu base alloy includes from about 3.4 to about 4.0 weight percent Cu, from 0 to about 0.4 weight percent Mn, from about 1.0 to about 1.6 weight percent Mg, and from about 0.09 to about 0.12 weight percent Zr.

92. The aircraft fuselage sheet of claim 87, wherein the Al—Cu base alloy includes from about 3.2 to about 3.8 weight percent Cu, from about 0.3 to about 0.7 weight percent Mn, from about 1.0 to about 1.6 weight percent Mg, and from about 0.09 to about 0.12 weight percent Zr.

93. The aircraft fuselage sheet of claim 86, wherein the aluminum alloy is an Al—Mg base alloy comprising aluminum, from about 0.2 to about 7 weight percent Mg, from 0 to about 1.5 weight percent Cu, and from 0 to about 3 weight percent Zn.

94. The aircraft fuselage sheet of claim 86, wherein the aluminum alloy is an Al—Zn base alloy comprising aluminum, from about 1 to about 10 weight percent Zn, from about 0.1 to about 3 weight percent Cu, from about 0.1 to about 3 weight percent Mg, and from 0 to about 2 weight percent Ag.

95. The aircraft fuselage sheet of claim 86, wherein the sheet is oriented on the aircraft with the length of the grains substantially perpendicular to a predominant fatigue crack growth direction through the sheet.

96. The aircraft fuselage sheet of claim 95, wherein the predominant fatigue crack growth direction is substantially parallel with an axial direction of the aircraft fuselage.

97. The aircraft fuselage sheet of claim 95, wherein the predominant fatigue crack growth direction is substantially parallel with a circumferential direction of the aircraft fuselage.

98. A rolled aluminum alloy sheet product comprising an anisotropic microstructure defined by grains having an average length to width aspect ratio of greater than about 4 to 1, wherein the sheet product comprises unrecrystallized grains having a Brass texture of greater than 20 and/or recrystallized grains having a Goss texture of greater than 20, and the aluminum alloy is substantially Li free and comprises a maximum of 4.0 weight percent Cu and a maximum of 0.2 weight percent Si.

99. A rolled aluminum alloy sheet product comprising an anisotropic microstructure defined by grains having an average length to width aspect ratio of greater than about 4 to 1, wherein the sheet product comprises unrecrystallized grains having a Brass texture greater than 20 and/or recrystallized grains having a Goss texture of greater than 20, and the aluminum alloy is substantially free of Li and comprises a maximum of 4.0 weight percent Cu, a maximum of 0.7 weight percent Mn, and a maximum of 0.2 weight percent Si.

100. An Al—Cu base alloy sheet product comprising aluminum, from about 1 to 4.0 weight percent Cu, up to about 6 weight percent Mg, up to about 1 weight percent Mn, up to about 0.5 weight percent Zr, up to about 0.2 weight percent Si, and is substantially free of Li, wherein the sheet product comprises an anisotropic microstructure defined by grains having an average length to width aspect ratio of greater than about 4 to 1, and the sheet product comprises unrecrystallized grains having a Brass texture of greater than 20 and/or recrystallized grains having a Goss texture of greater than 20.

101. An Al—Cu base alloy sheet product comprising aluminum, from about 1 to about 4.0 weight percent Cu, up to about 6 weight percent Mg, up to about 0.7 weight percent Mn, up to about 0.5 weight percent Zr, up to about 0.2 weight percent Si, and is substantially free of Li, wherein the sheet product comprises an anisotropic microstructure defined by grains having an average length to width aspect ratio of grater than about 4 to 1, and the sheet product comprises unrecrystallized grains having a Brass texture of greater than 20 and/or crystallized grains having a Goss texture of greater than 20.

102. An aircraft fuselage sheet comprising a rolled aluminum alloy sheet product comprising an anistropic microstructure defined by grains having an average length to width aspect ratio of greater than about 4 to 1, wherein the sheet product comprises unrecrystallized grains having a Brs texture of greater than 20 and/or recrystallized grains having a Goss texture of greater than 20, and the aluminum alloy is substantially Li free and comprises a maximum of 4.0 weight percent Cu and a maximum of 0.2 weight percent Si.

103. An aircraft fuselage sheet comprising a rolled aluminum alloy sheet product comprising an anistropic microstructure defined by grains having an average length to width aspect ratio of greater than about 4 to 1, wherein the sheet product comprises unrecrystallized grains having a Brass texture of greater than 20 and/or recrystallized grains having a Goss texture of greater than 20, and the aluminum alloy is substantially Li free and comprises a maximum of 4.0 weight percent Cu, a maximum of 0.7 weight percent Mn, and a max of 0.2 weight percent Si.

* * * * *